US008290421B2

(12) United States Patent
Sato et al.

(10) Patent No.: US 8,290,421 B2
(45) Date of Patent: Oct. 16, 2012

(54) POWDER RECOVERY CONTAINER AND IMAGE FORMING APPARATUS

(75) Inventors: Tomonori Sato, Kanagawa (JP); Hiroki Ando, Kanagawa (JP); Satoshi Honobe, Kanagawa (JP); Tsuneo Fukuzawa, Kanagawa (JP); Fumiaki Maekawa, Kanagawa (JP); Toshiyuki Matsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 128 days.

(21) Appl. No.: 12/853,127

(22) Filed: Aug. 9, 2010

(65) Prior Publication Data

US 2011/0103856 A1 May 5, 2011

(30) Foreign Application Priority Data

Oct. 29, 2009 (JP) ..... 2009-248675

(51) Int. Cl.
*G03G 21/12* (2006.01)

(52) U.S. Cl. ..... 399/360; 399/103; 399/120

(58) Field of Classification Search ..... 399/358, 399/360, 123, 120, 103, 105
See application file for complete search history.

(56) References Cited

U.S. PATENT DOCUMENTS

| | | | | |
|---|---|---|---|---|
| 5,132,740 | A | 7/1992 | Okamoto et al. | |
| 6,041,212 | A | 3/2000 | Okada | |
| 6,526,243 | B2 | 2/2003 | Kim et al. | |
| 6,782,235 | B2 | 8/2004 | Serizawa et al. | |
| 7,221,887 | B2 | 5/2007 | Kimura et al. | |
| 2006/0083540 | A1 * | 4/2006 | Kadowaki et al. | 399/360 |
| 2007/0196117 | A1 * | 8/2007 | Ishii | 399/35 |
| 2011/0123207 | A1 * | 5/2011 | Sato et al. | 399/360 |

FOREIGN PATENT DOCUMENTS

| | | | |
|---|---|---|---|
| JP | 60-134273 | A * | 7/1985 |
| JP | 2002-169435 | A | 6/2002 |
| JP | 3794263 | B2 | 7/2006 |

* cited by examiner

*Primary Examiner* — Sophia S Chen
(74) *Attorney, Agent, or Firm* — Sughrue Mion, PLLC

(57) ABSTRACT

A powder recovery container includes a reservoir chamber that stores a recovered powder; a recovery port that faces the reservoir chamber, a powder conveying unit that conveys and recovers the powder through the recovery port being removably inserted into the recovery port; a pair of door panels having rotating shafts arranged at two positions with the recovery port arranged therebetween, the door panels being rotated toward the reservoir chamber around the rotating shafts to open and close the recovery port; sealing members attached to the door panels, the sealing members overlapping one another between distal ends of the door panels to seal a gap between the distal ends of the door panels when the door panels are located at positions, at which the recovery port is closed; and urging members that urge the door panels in a direction, in which the recovery port is closed.

8 Claims, 21 Drawing Sheets

POWDER RECOVERY CONTAINER AND IMAGE FORMING APPARATUS

CROSS-REFERENCE TO RELATED APPLICATIONS

This application is based on and claims priority under 35 USC 119 from Japanese Patent Application No. 2009-248675 filed Oct. 29, 2009.

BACKGROUND (i) Technical Field

The present invention relates to a powder recovery container and an image forming apparatus.

(ii) Related Art

In an image forming apparatus, such as an electrophotographic copier or a laser beam printer, a toner image developed on a photoconductor drum is transferred on a recording sheet, and then a cleaner removes a remaining toner adhering to the photoconductor drum. The removed remaining toner is recovered as a waste toner (a used powder) in a waste-toner recovery box (a powder recovery container) in the image forming apparatus.

In recent years, there is a color image forming apparatus that obtains a color image such that toner images with plural colors formed by plural image forming engines are first transferred from photoconductor drums onto an intermediate transfer belt, and then are second transferred from the intermediate transfer belt onto a recording sheet. In the case of the color image forming apparatus, the photoconductor drums and cleaners that clean the photoconductor drums are provided respectively for, for example, image forming engines of yellow, cyan, magenta, and black. Waste toners have to be recovered from the cleaners of the four image forming engines. After the toner image is second transferred from the intermediate transfer belt onto the recording sheet, a remaining toner adhering to the intermediate transfer belt has to be cleaned. A cleaner is also provided for the intermediate transfer belt. Thus, in the case of the color image forming apparatus, the waste toners from the plural cleaners are recovered in the waste-toner recovery box.

The waste-toner recovery box is an expendable supply. When the waste-toner recovery box is full, the waste-toner recovery box is typically replaced with an empty waste-toner recovery box.

SUMMARY

According to an aspect of the invention, there is provided a powder recovery container including a container body having a wall surface; a reservoir chamber that stores a recovered powder; a recovery port that faces the reservoir chamber, a powder conveying unit that conveys and recovers the powder through the recovery port being removably inserted into the recovery port; a pair of door panels having rotating shafts arranged at two positions with the recovery port arranged therebetween, the door panels being rotated toward the reservoir chamber around the rotating shafts to open and close the recovery port; sealing members attached to the door panels, the sealing members overlapping one another between distal ends of the door panels to seal a gap between the distal ends of the door panels when the door panels are located at positions, at which the recovery port is closed; and urging members that urge the door panels in a direction, in which the recovery port is closed.

BRIEF DESCRIPTION OF THE DRAWINGS

Exemplary embodiment(s) of the present invention will be described in detail based on the following figures, wherein.

DETAILED DESCRIPTION

Figure 1:
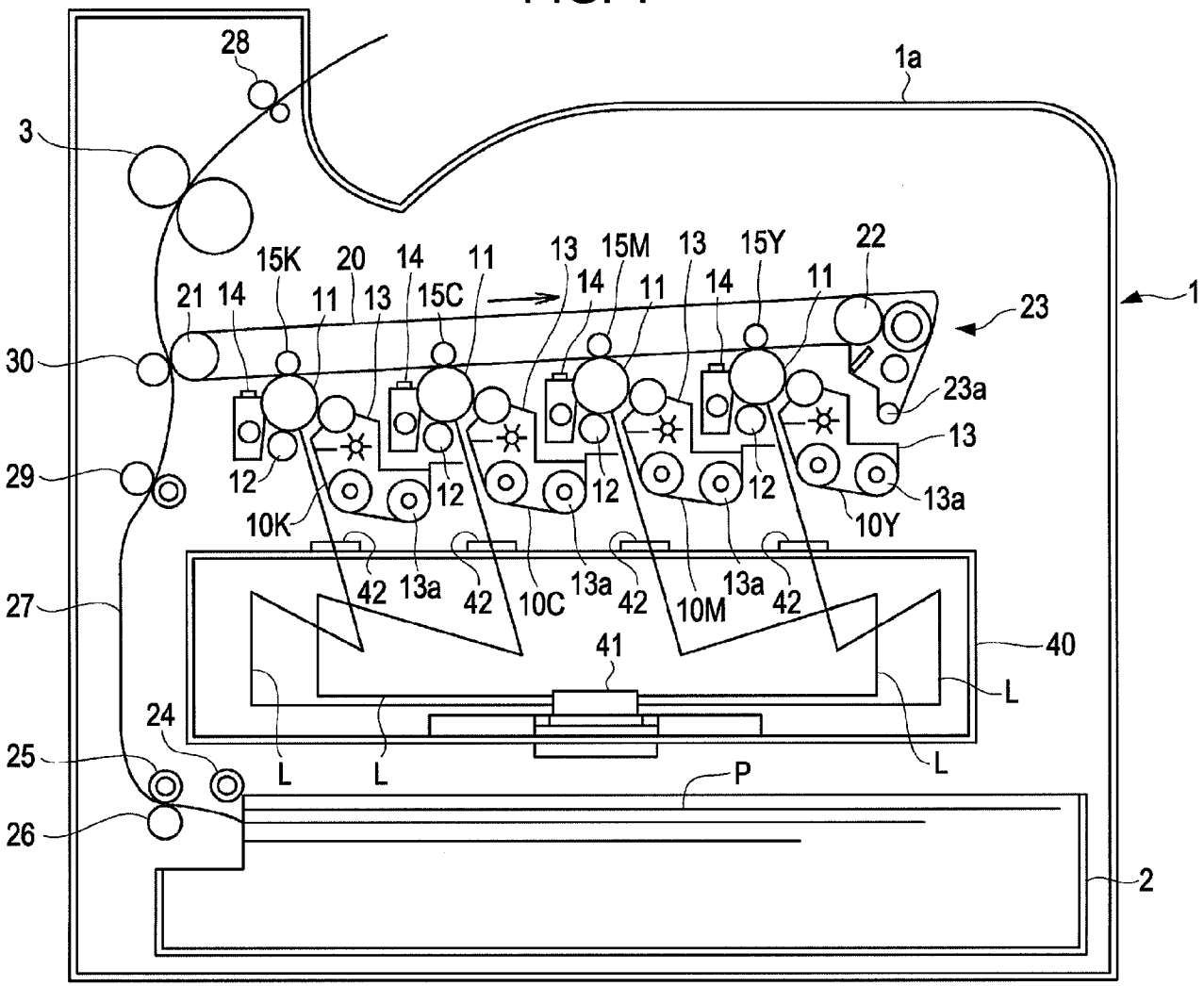
FIG. 1 briefly illustrates a configuration of a printer having a waste-toner recovery box according to an exemplary embodiment of the invention attached to the printer.

An exemplary embodiment as an example of the present invention will be described in detail below with reference to the attached drawings. In the drawings for describing the exemplary embodiment, the same reference signs are basically applied to equivalent components, and the redundant description is omitted.

Referring to FIG. 1, a tandem-type color laser beam printer 1 (an example of an image forming apparatus) having a waste-toner recovery box attached to the printer 1 includes four image forming engines 10Y, 10M, 10C, and 10K that form toner images of colors including yellow, magenta, cyan, and black. The printer 1 also includes an intermediate transfer belt 20. The toner images from the image forming engines 10Y, 10M, 10C, and 10K are transferred on the intermediate transfer belt 20 in a superposed manner (first transfer). The toner images transferred on the intermediate transfer belt 20 in a superposed manner are transferred on a recording sheet P (second transfer), and hence a full-color image is formed.

The intermediate transfer belt 20 is an endless belt and wound around a pair of belt conveying rollers 21 and 22. The intermediate transfer belt 20 receives the first transfer of the toner images formed by the image forming engines 10Y, 10M, 10C, and 10K of the respective colors while the intermediate transfer belt 20 is rotated in a direction indicated by an arrow in FIG. 1.

A second transfer roller 30 is provided at a position to face the one belt conveying roller 21 with the intermediate transfer belt 20 arranged therebetween. The recording sheet P passes through a portion between the second transfer roller 30 and the intermediate transfer belt 20 that mutually contact one another with a pressure, and receives the secondary transfer of the toner images from the intermediate transfer belt 20. A belt cleaner 23 for the intermediate transfer belt 20 is arranged at a position to face the other belt conveying roller 22. The belt cleaner 23 removes the toner remaining on and adhering to the intermediate transfer belt 20 after the second transfer, from the intermediate transfer belt 20. The remaining toner removed by the belt cleaner 23 is conveyed as a waste toner to the front (a near side in FIG. 1) by a conveying shaft 23*a* that includes a spiral blade, and is recovered in a waste-toner recovery box (described later).

The four image forming engines 10Y, 10M, 10C, and 10K are arranged in parallel below the intermediate transfer belt 20. The image forming engines 10Y, 10M, 10C, and 10K first transfer the toner images that are formed in accordance with image information of the respective colors onto the intermediate transfer belt 20. The four image forming engines 10Y, 10M, 10C, and 10K are arranged in order of yellow, magenta, cyan, and black in a rotation direction of the intermediate transfer belt 20. The black-image forming engine 10K that is generally the most frequently used is arranged nearest the second transfer position.

A raster scanning unit 40 is provided below the image forming engines 10Y, 10M, 10C, and 10K. The raster scanning unit 40 exposes photoconductor drums 11 of the respective image forming engines 10Y, 10M, 10C, and 10K with light in accordance with image information. The raster scanning unit 40 is common to all the image forming engines 10Y, 10M, 10C, and 10K, and includes four semiconductor lasers (not shown) that emit laser beams L that are modulated in accordance with the image information of the respective colors, and a polygonal mirror 41 that rotates at a high speed and causes the laser beams L to axially scan the photoconductor drums 11. The laser beams L from the polygonal mirror 41 are reflected by mirrors (not shown) and propagate in predetermined paths. The photoconductor drums 11 of the image forming engines 10Y, 10M, 10C, and 10K are exposed with the laser beams L through scanning windows 42 provided in an upper portion of the raster scanning unit 40.

Each of the image forming engines 10Y, 10M, 10C, and 10K includes the photoconductor drum 11, a charging roller 12 that electrically charges the surface of the photoconductor drum 11 to have a predetermined potential, a developing unit 13 that develops an electrostatic latent image formed on the photoconductor drum 11 by the exposure with the laser beam L and forms a toner image, and a drum cleaner 14 that removes a remaining toner and paper dust from the surface of the photoconductor drum 11 after the toner image is transferred on the intermediate transfer belt 20. The toner images in accordance with the image information of the respective colors are formed on the photoconductor drums 11.

In the printer 1 according to this exemplary embodiment, the developing unit 13 uses a two-component powder containing a toner and a carrier. To omit maintenance work for exchanging the powder deteriorated with time, a trickle development system is used in which the powder containing the toner and the carrier is supplied from a supply cartridge (not shown), and the deteriorated powder is automatically exhausted.

Each developing unit 13 is supplied with a new powder from the rear (a far side in FIG. 1) of a conveying shaft 13*a* including a spiral blade like the conveying shaft 23*a*. A remaining toner removed by each drum cleaner 14 is exhausted as a waste toner to the front by a conveying shaft (not shown). The waste toner exhausted from the drum cleaner 14 is recovered in a waste-toner recovery box (described later).

Exemplary powders to be recovered according to this exemplary embodiment are waste toners including used toners exhausted from the drum cleaners 14 and a used toner exhausted from the belt cleaner 23. For example, a recovery box that recovers the carrier and the toner exhausted from the developing unit 13, or a recovery box that recovers only the used toners exhausted from the drum cleaners 14 may be used.

First transfer rollers 15Y, 15M, 15C, and 15K are provided at positions to face the photoconductor drums 11 of the image forming engines 10Y, 10M, 10C, and 10K with the intermediate transfer belt 20 arranged therebetween. When transfer bias voltages are applied to the transfer rollers 15Y, 15M, 15C, and 15K, electric fields are formed between the photoconductor drums 11 and the transfer rollers 15Y, 15M, 15C, and 15K. The toner images on the photoconductor drums 11 with electric charges are transferred on the intermediate transfer belt 20 by Coulomb forces.

Meanwhile, the recording sheet P is transported from a sheet feed cassette 2 accommodated in a lower portion of the printer 1, to the inside of a housing, and more particularly to the second transfer position at which the intermediate transfer belt 20 contacts the second transfer roller 30. To set the sheet feed cassette 2, the sheet feed cassette 2 is pushed into the printer 1 from the front of the printer 1. A pickup roller 24 and a sheet feed roller 25 are provided above the set sheet feed cassette 2. The pickup roller 24 picks up the recording sheet P in the sheet feed cassette 2. Also, a retard roller 26 is provided at a position to face the sheet feed roller 25. The retard roller 26 prevents double feeding of recording sheets P.

A transport path 27 for the recording sheet P in the printer 1 is provided in a vertical direction along a left side surface of the printer 1. The recording sheet P picked from the sheet feed cassette 2 located at the bottom of the printer 1 is elevated in the transport path 27. A registration roller 29 controls an entry timing of the recording sheet P and introduces the recording sheet P to the second transfer position. The toner images are transferred on the recording sheet P at the second transfer position. Then, the recording sheet P is sent to a fixing unit 3 provided in an upper portion of the printer 1. The fixing unit 3 fixes the toner images to the recording sheet P. An output roller 28 outputs the recording sheet P with the fixed toner images, on a sheet output tray 1*a* provided on an upper surface of the printer 1, in a state in which an image formed surface of the recording sheet P faces the lower side.

When a full-color image is formed by the color laser beam printer 1 with such a configuration, the raster scanning unit 40 exposes the photoconductor drums 11 of the image forming engines 10Y, 10M, 10C, and 10K with light in accordance with the image information of the respective colors at a predetermined timing. Accordingly, electrostatic latent images are formed on the photoconductor drums 11 of the image forming engines 10Y, 10M, 10C, and 10K in accordance with the image information. By supplying the electrostatic latent images with the toners, the toner images are formed.

The toner images formed on the photoconductor drums 11 of the image forming engines 10Y, 10M, 10C, and 10K are successively transferred on the rotating intermediate transfer belt 20. Thus, the multiple toner images, in which the toner images of the respective colors are superposed on one another, are formed on the intermediate transfer belt 20. Meanwhile, the recording sheet P is sent from the sheet feed cassette 2 and passes through the portion between the second transfer roller 30 and the intermediate transfer belt 20 at a proper timing at which the toner images which have been first transferred on the intermediate transfer belt 20 reach the second transfer position. Accordingly, the multiple toner images on the intermediate transfer belt 20 are second transferred on the recording sheet P. The fixing unit 3 fixes the second transferred toner images to the recording sheet P. Thus, the image formation of a full-color image on the recording sheet P is completed.

In the printer 1 according to this exemplary embodiment having such a configuration, all the waste toners exhausted from the belt cleaner 23 and the respective drum cleaners 14 are recovered in a single waste-toner recovery box 50 (an example of a powder recovery container).

Figure 2:
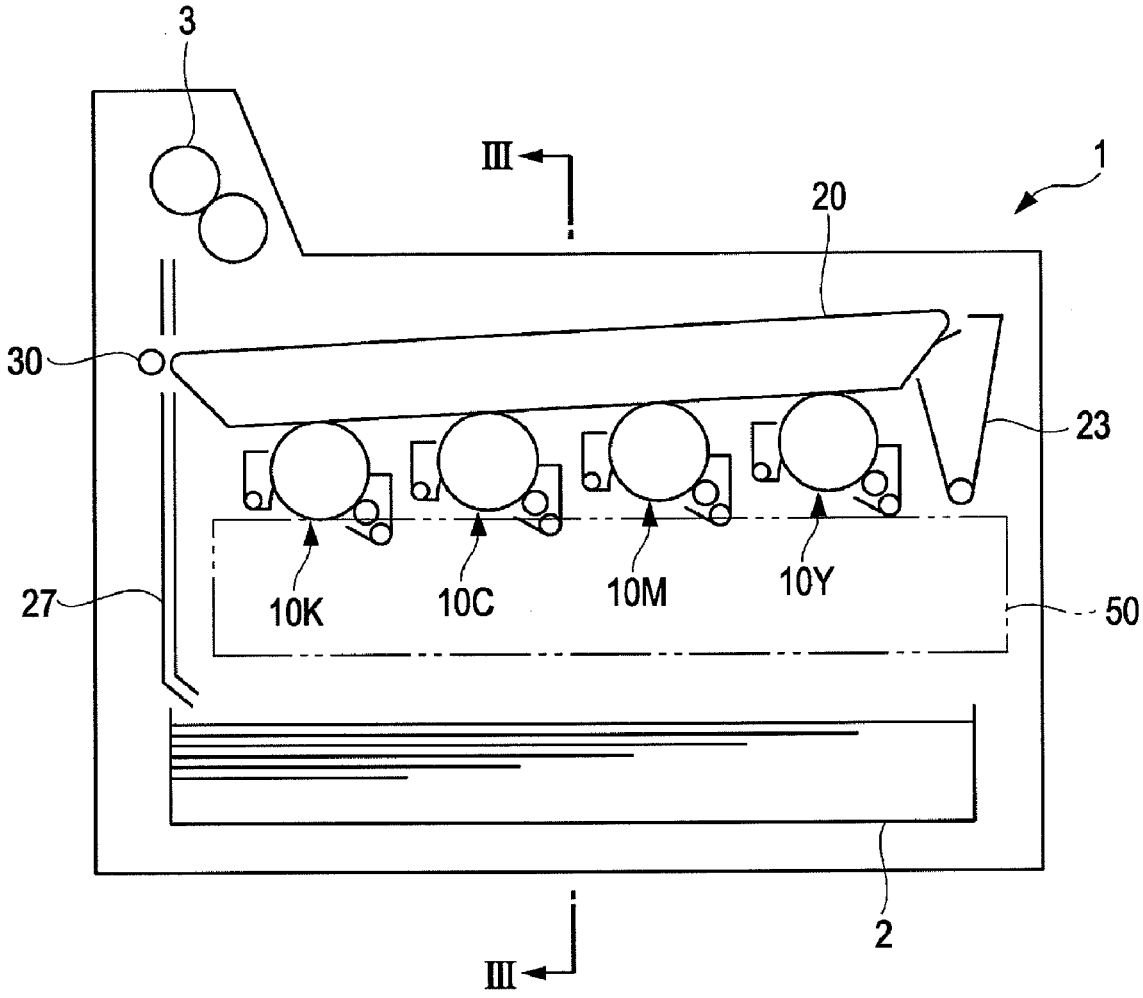
FIG. 2 briefly illustrates an arranged position of the waste-toner recovery box in the printer shown in FIG. 1.
Figure 3:
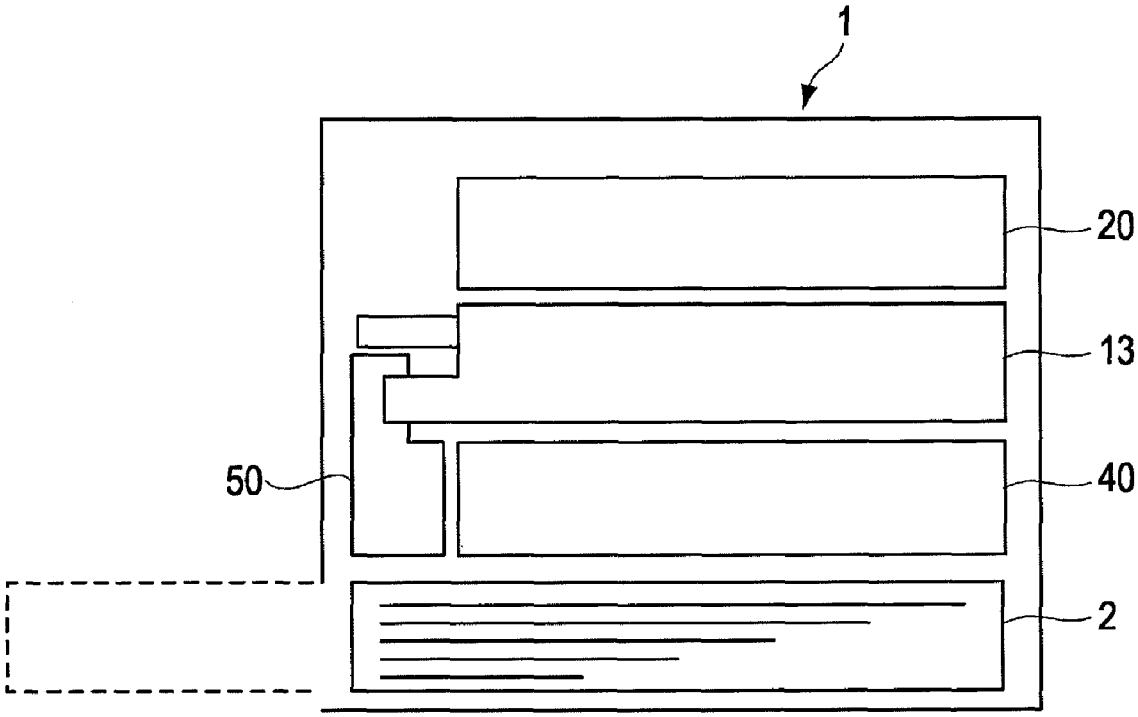
FIG. 3 is a cross-sectional view taken along line III-III in FIG. 2.

Referring to FIGS. 2 and 3, the waste-toner recovery box 50 is provided at the front of the image forming engines 10Y, 10M, 10C, and 10K of yellow, magenta, cyan, and black that are arranged in parallel. The waste-toner recovery box 50 is provided at a position slightly below the image forming engines 10Y, 10M, 10C, and 10K. The waste toners exhausted from the drum cleaners 14 to the front are recovered in the waste-toner recovery box 50. The waste toner removed from the intermediate transfer belt 20 by the belt cleaner 23 is also recovered in the waste-toner recovery box 50.

Referring to FIGS. 4 to 7, the waste-toner recovery box 50 includes a front cover 51 and a rear cover 52 made of plastic. The front and rear covers 51 and 52 are combined and hence define a container body 50*a*. The container body 50*a* has spaces therein. The waste-toner recovery box 50 is long in the width direction. The thickness of the waste-toner recovery box 50 is smaller than the length thereof in the vertical direction. The length in the width direction of the waste-toner recovery box 50 is longer than a length from the drum cleaner 14 for the black-image forming engine 10K to the belt cleaner 23. When the waste-toner recovery box 50 is attached to the printer 1, the waste-toner recovery box 50 is located at the front of the image forming engines 10Y, 10M, 10C, and 10K and the belt cleaner 23. Thus, the waste toner is directly dropped into the inner space (the reservoir chamber 61).

Figure 4:
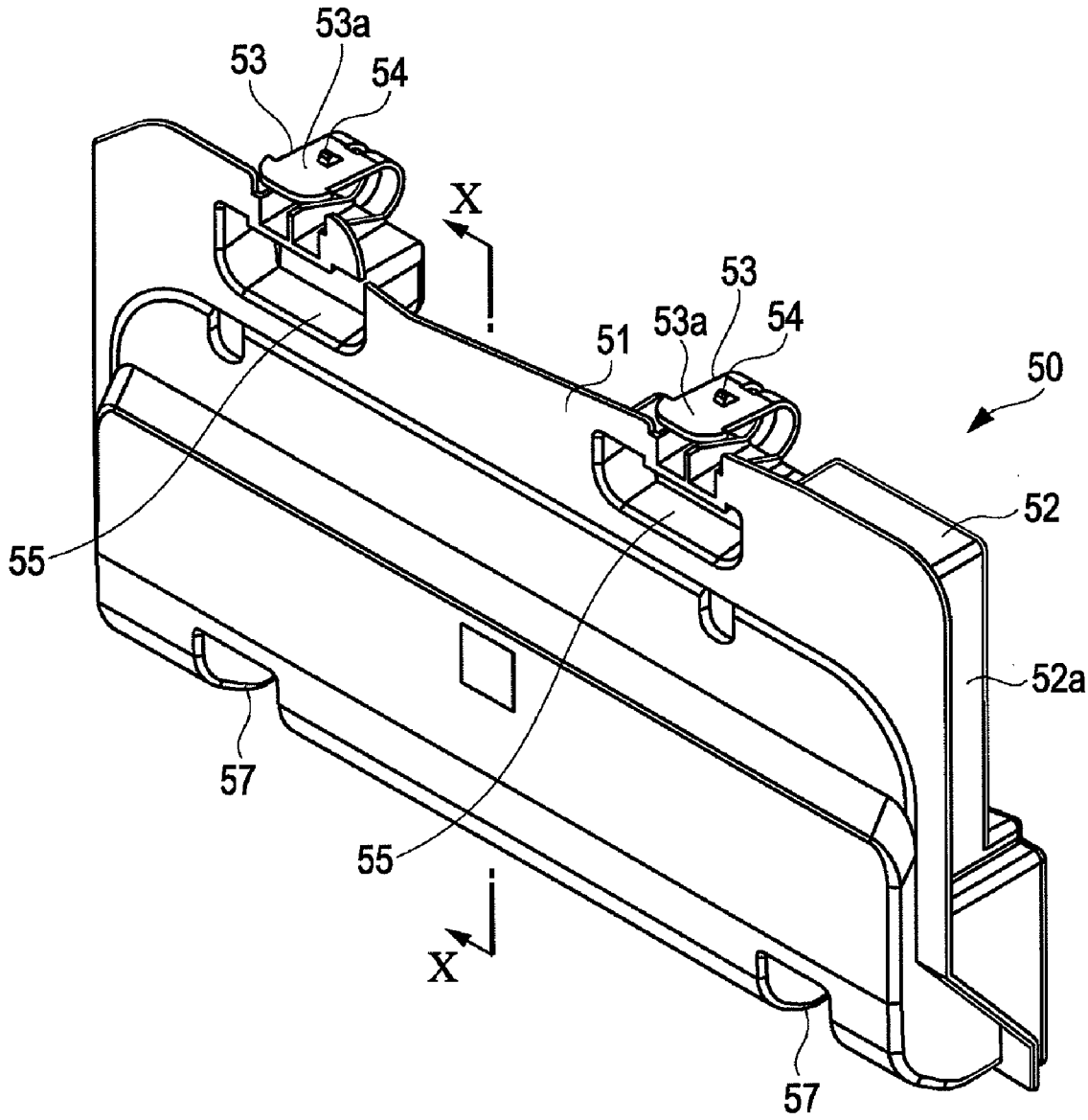
FIG. 4 is a perspective view showing the waste-toner recovery box according to the exemplary embodiment of the invention when viewed from a front surface.
Figure 5:
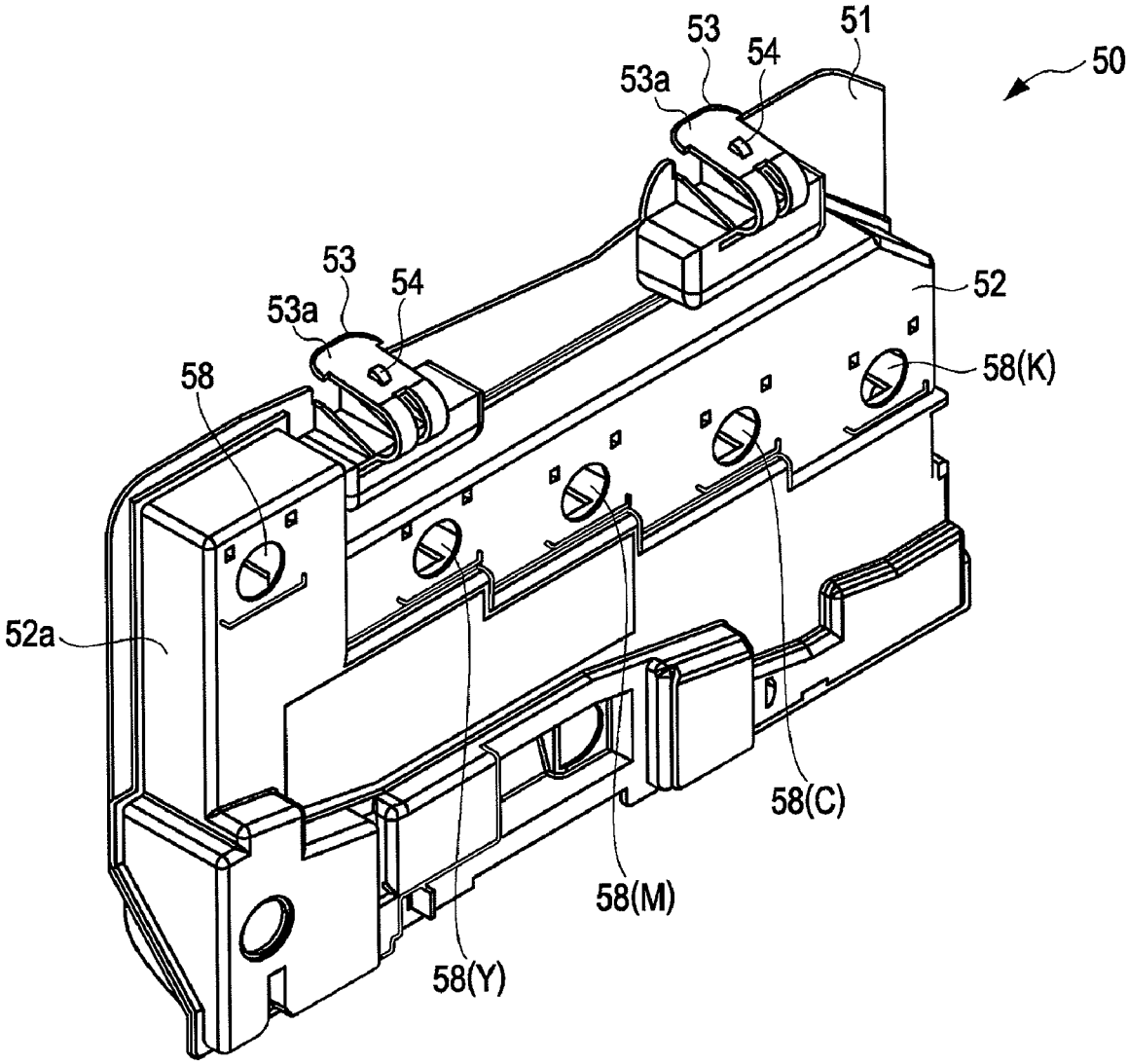
FIG. 5 is a perspective view showing the waste-toner recovery box according to the exemplary embodiment of the invention when viewed from a rear surface.
Figure 6:
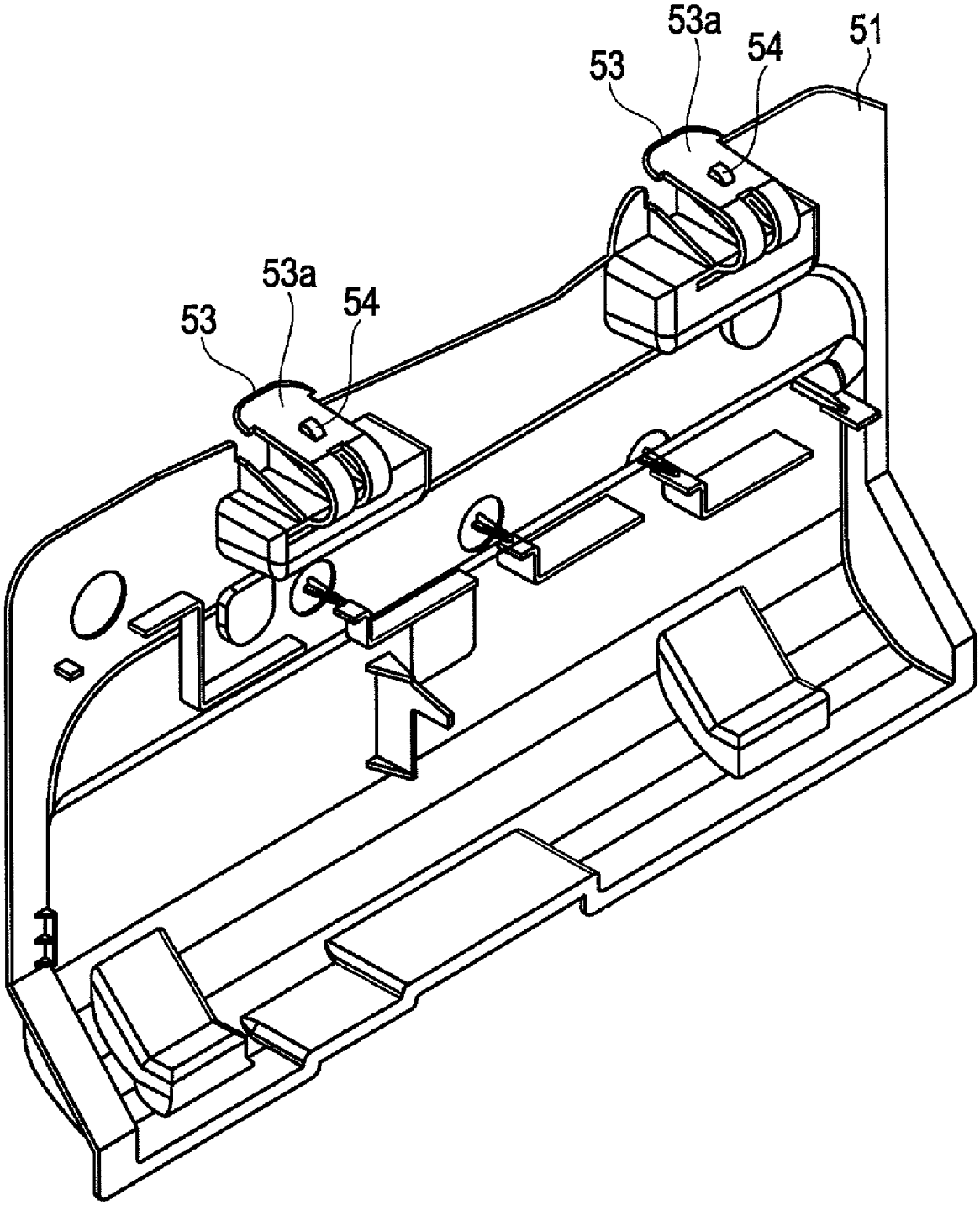
FIG. 6 is a perspective view showing the inside of a front cover that is a component of the waste-toner recovery box according to the exemplary embodiment of the invention.

Referring to FIGS. 4, 5, and 6, lock pieces 53 are provided at two positions of an upper portion of the front cover 51. Each lock piece 53 has a free end facing the front, and has an upper surface 53*a* and a protrusion 54 on the upper surface 53*a*. The lock piece 53 is elastically deformable such that the upper surface 53*a* is vertically moved. Also, holes 55 are formed directly below the lock pieces 53. Each hole 55 is open to the front and has a size that allows several fingers to enter the hole 55. Further, the front cover 51 includes plate piece attachments 57 at two positions of a lower portion of the front cover 51. Plate pieces 56 protruding downward (FIG. 8) are attached to the plate piece attachments 57.

When the waste-toner recovery box 50 is attached to the printer 1, the plate pieces 56 are inserted into grooves (not shown) formed at the printer 1. The waste-toner recovery box 50 is raised while the inserted portions serve as supporting points. Then, the lock pieces 53 are fitted into fixing holes (not shown) formed at the printer 1 while the lock pieces 53 are elastically deformed. When the waste-toner recovery box 50 is detached from the printer 1, thumbs are hooked at the free ends of the lock pieces 53, and the other fingers are inserted into the holes 55. The lock pieces 53 are tilted forward while the lock pieces 53 are pushed down with the thumbs, so that the protrusions 54 are released from the fixing holes. Then, the waste-toner recovery box 50 is lifted obliquely upward.

The waste-toner recovery box 50 is detached from the printer 1, for example, when the waste-toner recovery box 50 is full or needs to be replaced because the intermediate transfer belt unit has to be replaced, or because the image forming engines 10Y, 10M, 10C, and 10K located at the deeper side with respect to the waste-toner recovery box 50 have to be replaced.

Figure 7:
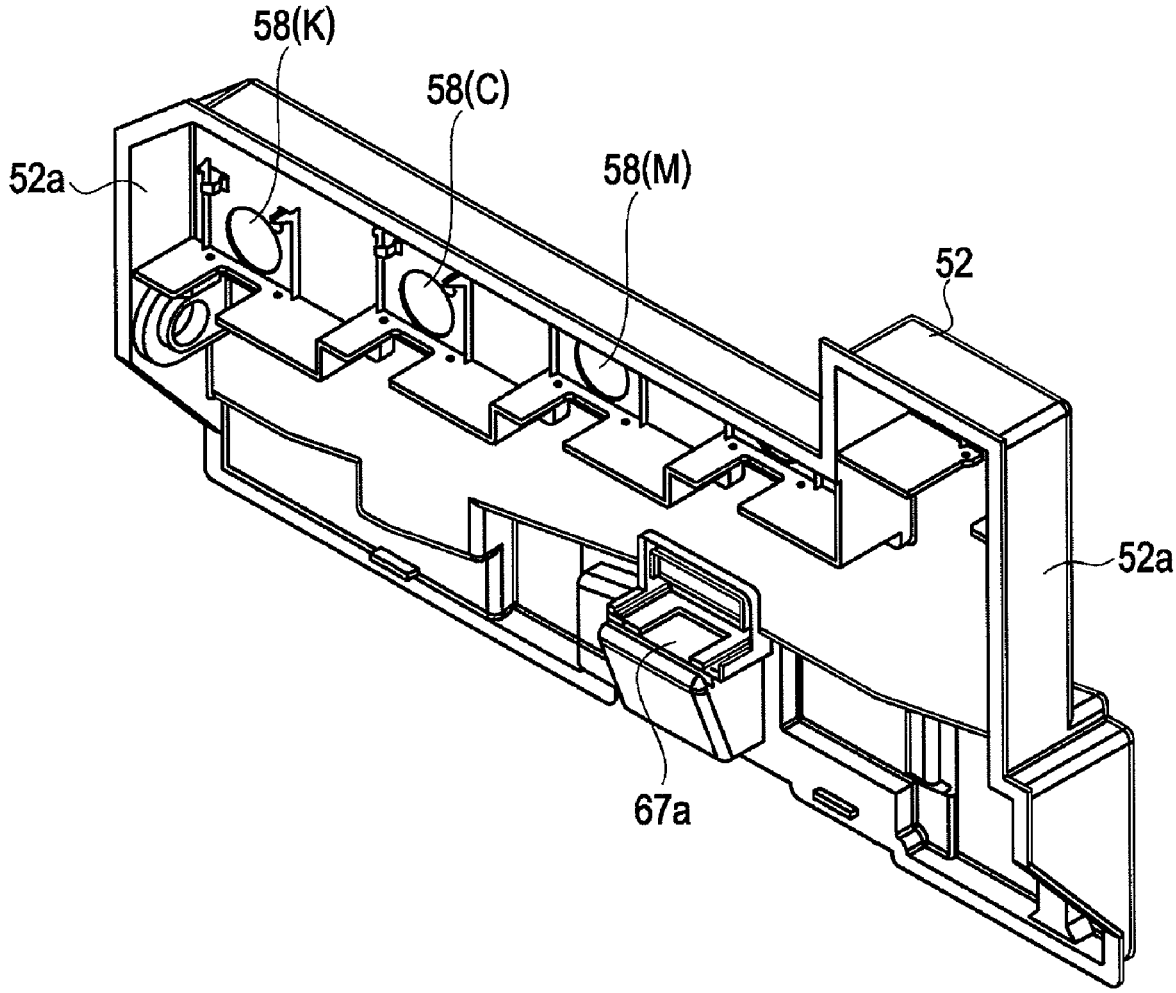
FIG. 7 is a perspective view showing the inside of a rear cover that is a component of the waste-toner recovery box according to the exemplary embodiment of the invention.

Referring to FIGS. 5 and 7, the rear cover 52 has five recovery ports 58 at an upper portion of the rear cover 52. The recovery ports 58 are for the waste toners that are exhausted from the drum cleaners 14 of the image forming engines 10Y, 10M, 10C, and 10K. When the waste-toner recovery box 50 is attached to the printer 1, coupling pipes (FIG. 20, an example of powder conveying units) that protrude from the drum cleaners 14 of the image forming engines 10Y, 10M, 10C, and 10K and the belt cleaner 23 to the front are removably inserted into the recovery ports 58. When the coupling pipes 74 that convey the recovered waste toners are inserted into the recovery ports 58, the waste toners exhausted from the drum cleaners 14 of the trickle system and conveyed through the coupling pipes 74 are dropped into the waste-toner recovery box 50. The five recovery ports 58 correspond to the drum cleaner 14 of black, the drum cleaner 14 of cyan, the drum cleaner 14 of magenta, the drum cleaner 14 of yellow, and the belt cleaner 23 in order from the right side in FIG. 5.

As described above, the waste-toner recovery box 50 is provided on one side of the parallel arranged image forming engines 10Y, 10M, 10C, and 10K and the belt cleaner 23, so as to cover these components. Thus, the waste toners exhausted from the image forming engines 10Y, 10M, 10C, and 10K and the belt cleaner 23 are directly dropped into the waste-toner recovery box 50.

Figure 8:
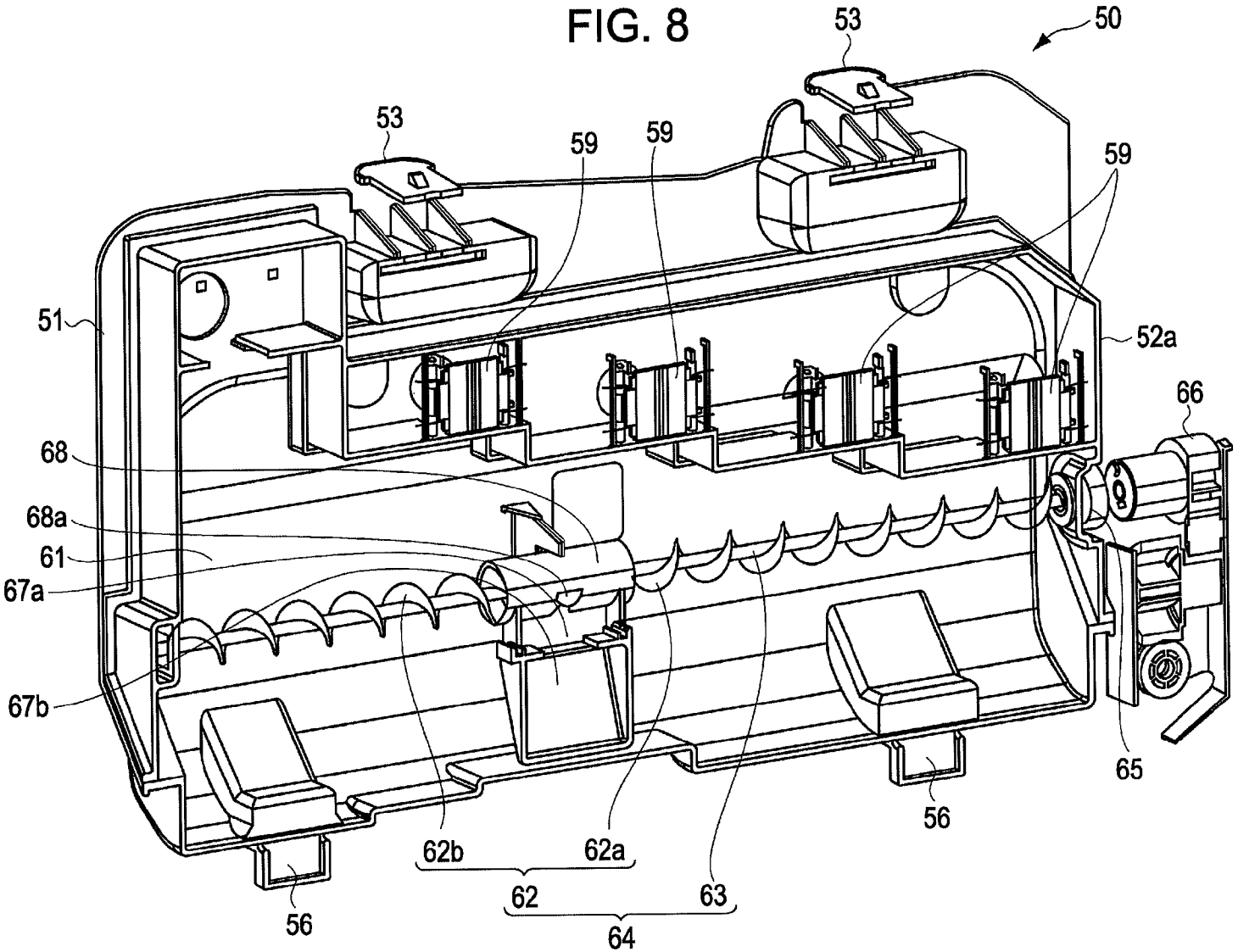
FIG. 8 is a perspective view showing an inner structure of the waste-toner recovery box according to the exemplary embodiment of the invention when viewed from the rear.
Figure 9:
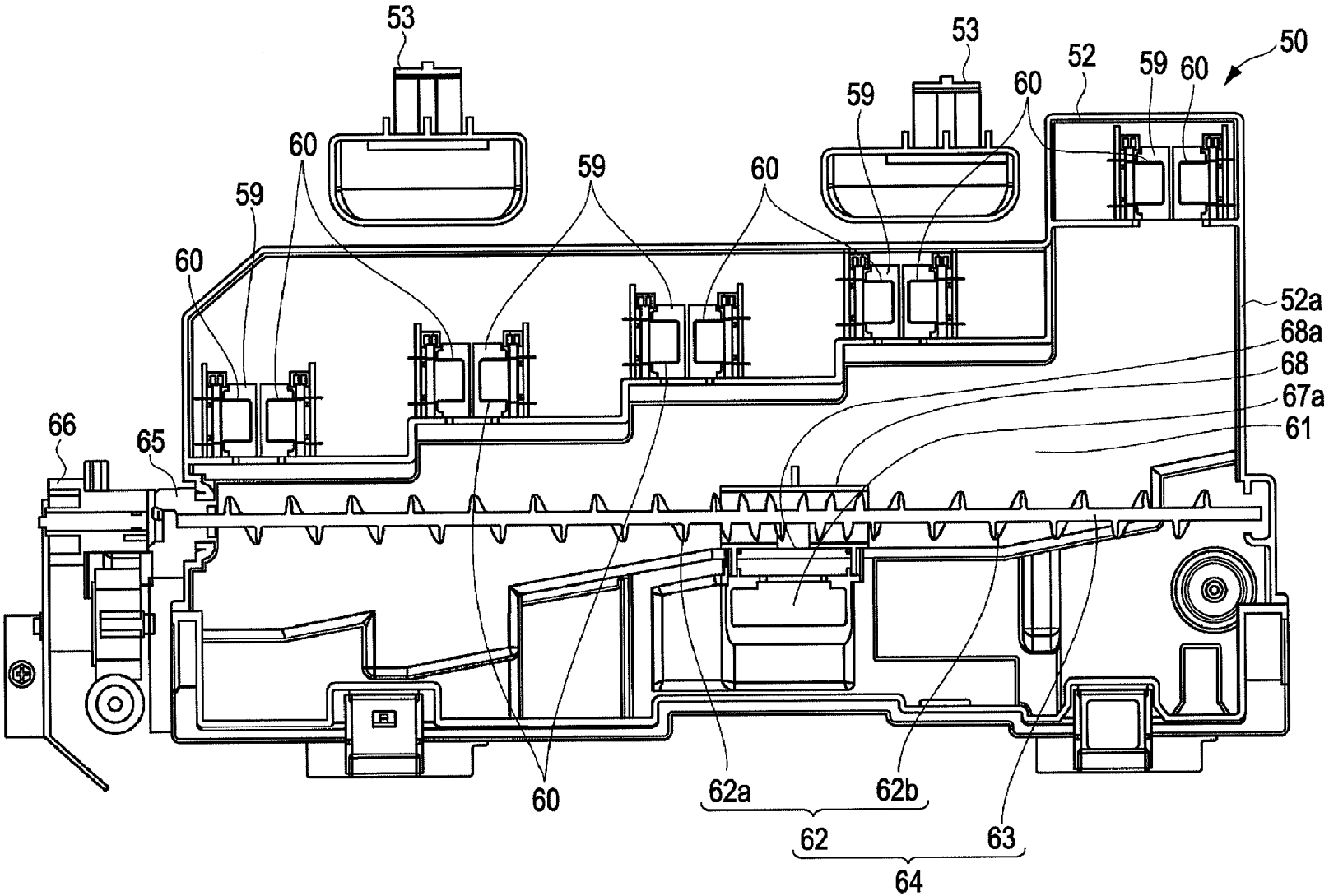
FIG. 9 is a perspective view showing an inner structure of the waste-toner recovery box according to the exemplary embodiment of the invention when viewed from the front.

Referring to FIG. 8, shutters 59 (an example of door panels) are provided at the recovery ports 58. A pair of the shutters 59 has a double-panel structure that opens left and right from the center. The shutters 59 are openably and closably attached to the inside of the rear cover 52. The shutters 59 have torsion springs 60 (an example of urging members) that press the shutters 59 to the wall surface of the rear cover 52 and close the recovery port 58 (FIG. 9). The torsion springs 60 provide spring forces (urging forces) by using restoration of twisted parts of the torsion springs 60. The shutters 59 normally close the recovery port 58 by the spring forces of the torsion springs 60. When each coupling pipe 74 is inserted into the recovery port 58, the coupling pipe 74 pushes the shutters 59 inward against the spring forces, and hence the recovery port 58 is open.

Referring to FIGS. 8 and 9, the waste-toner recovery box 50 formed of the front cover 51 and the rear cover 52 has the reservoir chamber 61 in the waste-toner recovery box 50. The reservoir chamber 61 stores the recovered waste toners. The reservoir chamber 61 is located below the recovery ports 58 facing the reservoir chamber 61. The waste toners are dropped in the reservoir chamber 61 from the coupling pipes 74 inserted into the recovery ports 58. When the reservoir chamber 61 is filled with the waste toners (when the quantity of the waste toners reaches a storage limit), the waste-toner recovery box 50 has to be replaced.

A conveying unit 64 is provided in the reservoir chamber 61 and extends in the longitudinal direction. The conveying unit 64 extends between side walls of the reservoir chamber 61 (that is, the conveying unit 64 extends between left and right side walls 52*a* of the rear cover 52). The waste toners dropped into the reservoir chamber 61 are accumulated like hills at positions directly below the recovery ports 58. When the tops of the hills exceed the storage limit of the waste-toner recovery box 50, the portion exceeding the storage limit is collapsed and conveyed.

One side of the conveying unit 64 is supported by a bearing 65 provided at the side wall 52*a*, and a distal end of the one side of the conveying unit 64 protrudes outside the side wall 52*a*. The distal end is a supply end through which a driving force (a torque) is supplied to the conveying unit 64. A transmission unit 66 is attached to the distal end. The transmission unit 66 includes a transmission gear train (not shown) that transmits a driving force from a drive source (not shown) provided in the printer 1 to the conveying unit 64. When the waste-toner recovery box 50 is attached to the printer 1, the transmission unit 66 is mechanically coupled with the drive source in the printer 1. Thus, the conveying unit 64 is driven (rotated) by the drive source.

The conveying unit 64 is fabricated by, for example, injection molding with synthetic resin. The conveying unit 64 has a rotating shaft 63 and a spiral blade 62 around the rotating shaft 63. The spiral blade conveys the waste toner. The spiral blade 62 includes a first blade 62*a* and a second blade 62*b* whose spiral directions differ from one another. The spiral directions of the blades 62*a* and 62*b* are directions in which the waste toners are conveyed from both ends of the rotating shaft 63 to the center.

The blades 62*a* and 62*b* are lacking in an area between a position directly below the recovery port 58 for the waste toner of yellow Y and a position directly below the recovery port 58 for the waste toner of magenta M. The positions define ends of conveyance. When the conveying unit 64 is rotated, the waste toners accumulated like hills in the reservoir chamber 61 are collapsed and conveyed toward those positions.

The blade for conveying the waste toner does not have to be the spiral blade, and may be plural flat blades provided at an interval. That is, the shape of the blade may be any shape as long as the blade has the function of conveying the waste toner.

Figure 10:
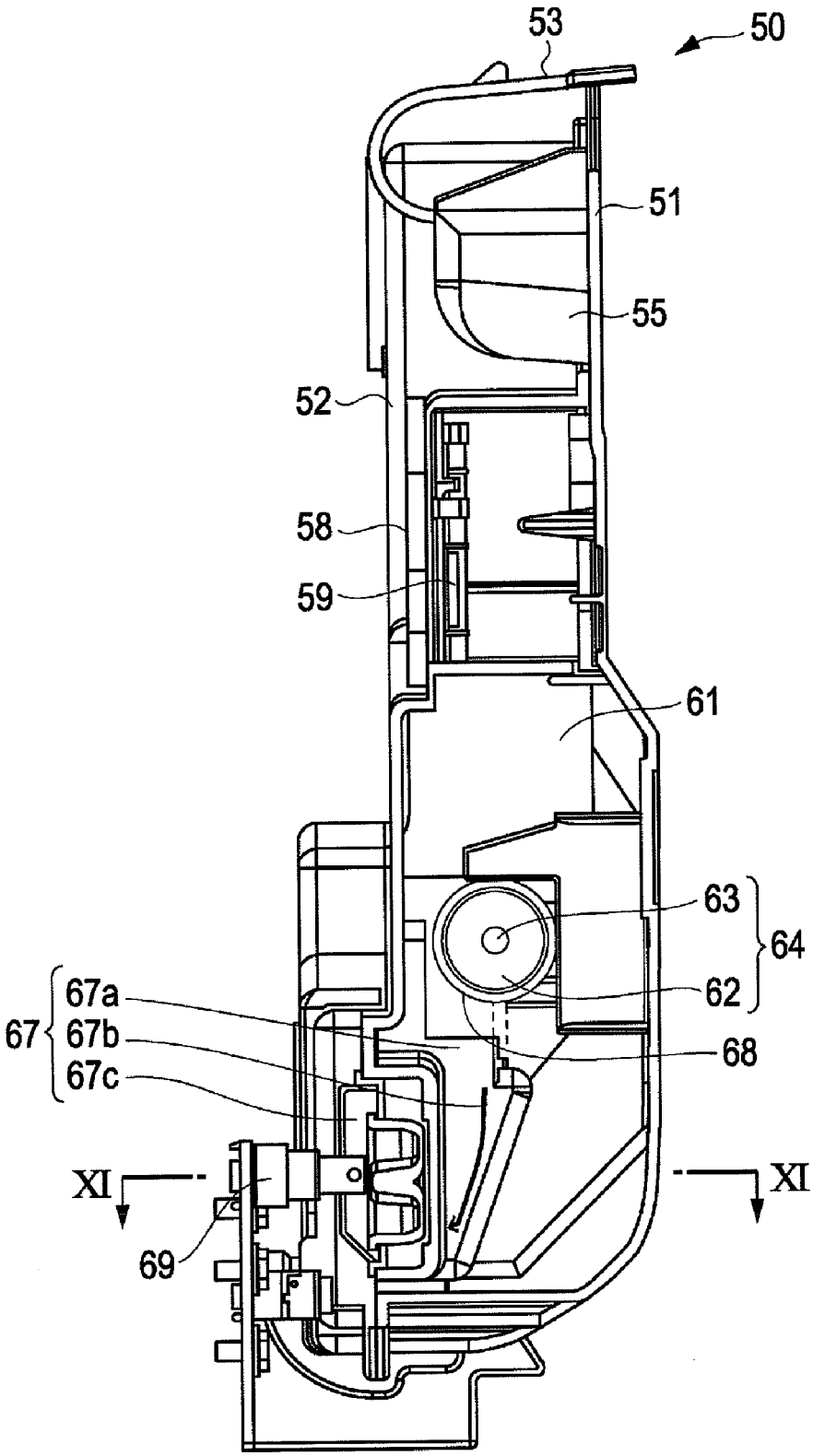
FIG. 10 is a cross-sectional view taken along line X-X in FIG. 4.

Referring to FIG. 10, a detection chamber 67 is provided in the waste-toner recovery box 50. The waste toner exceeding the storage limit of the reservoir chamber 61 enters the detection chamber 67. If the waste toner is accumulated to a predetermined level in the reservoir chamber 61 (that is, the storage limit of the reservoir chamber 61), the quantity of the waste toner exceeding the level (that is, exceeding the storage limit) enters the detection chamber 67.

Figure 11:
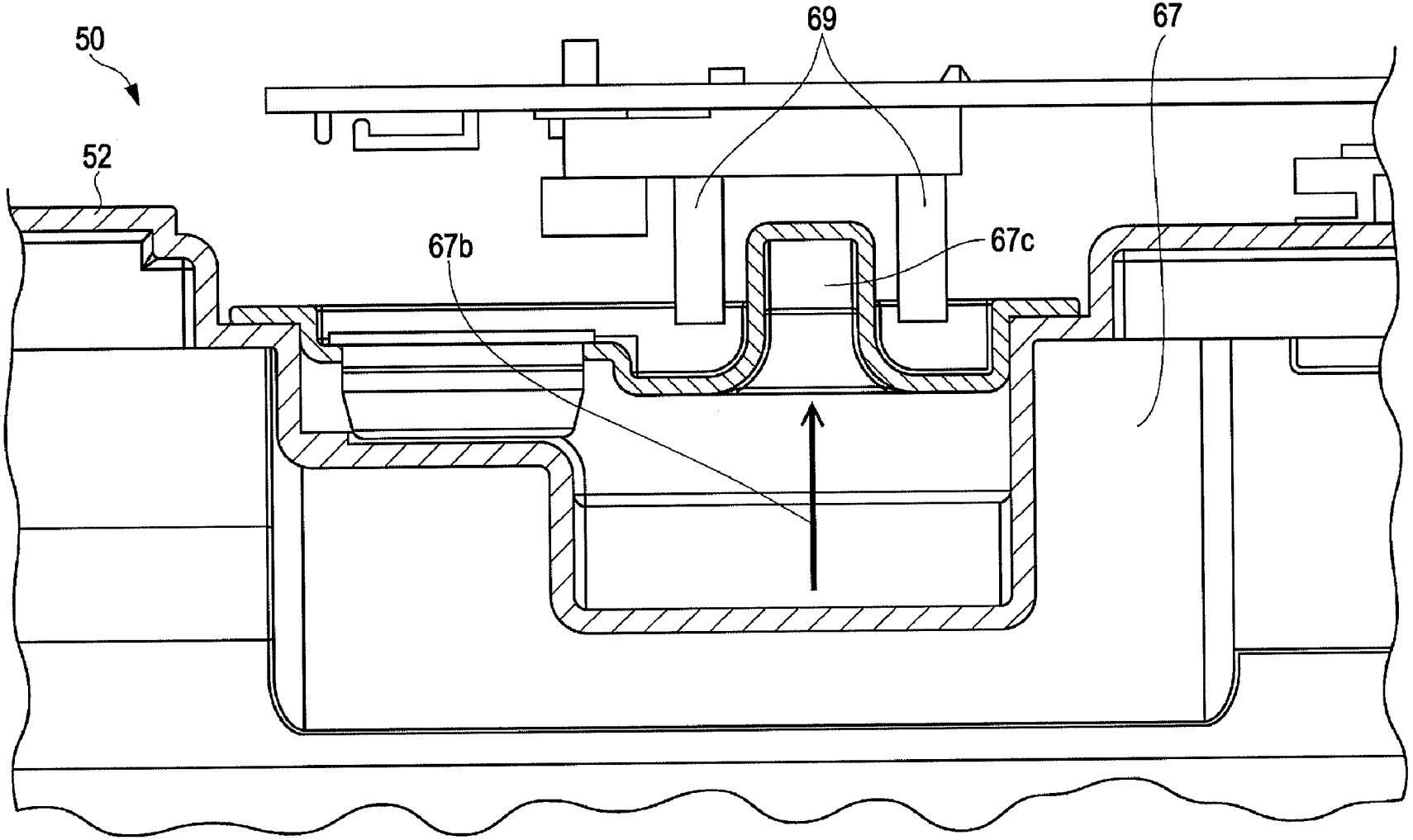
FIG. 11 is a cross-sectional view showing a specific part taken along line XI-XI in FIG. 10.

Referring to FIG. 11, the detection chamber 67 has a sensing chamber 67*c* that is attached to the rear cover 52 and formed of a transparent member protruding to the outside. When the waste-toner recovery box 50 is attached to the printer 1, the sensing chamber 67*c* is inserted into an area between a light-emitting portion and a light-receiving portion of a light transmission sensor 69 that is provided at the printer 1.

Referring to FIG. 10, a guide path 67*b* extends from an entrance 67*a* of the detection chamber 67. The guide path 67*b* has an inclined surface that is located below the conveying unit 64. The sensing chamber 67*c* is located ahead of the inclined surface. Namely, the sensing chamber 67*c* is not arranged directly below the entrance 67*a*. Thus, the waste toner dropped from the reservoir chamber 61 is gradually accumulated in the sensing chamber 67*c* because of the inclined surface of the guide path 67*b*. When the area between the light-emitting portion and the light-receiving portion of the light transmission sensor 69 is blocked by the waste toner in the sensing chamber 67*c*, the signal of the light transmission sensor 69 is changed. Accordingly, it is recognized whether the waste toner reaches the predetermined level of the reservoir chamber 61.

The entrance 67*a* of the detection chamber 67 is formed in an area not occupied by the first blade 62*a* or the second blade 62*b* of the conveying unit 64, i.e., at a position facing the ends of conveyance. Thus, the waste toner exceeding the storage limit of the reservoir chamber 61 is conveyed to the entrance 67*a* of the detection chamber 67 by the conveying unit 64.

Figure 12:
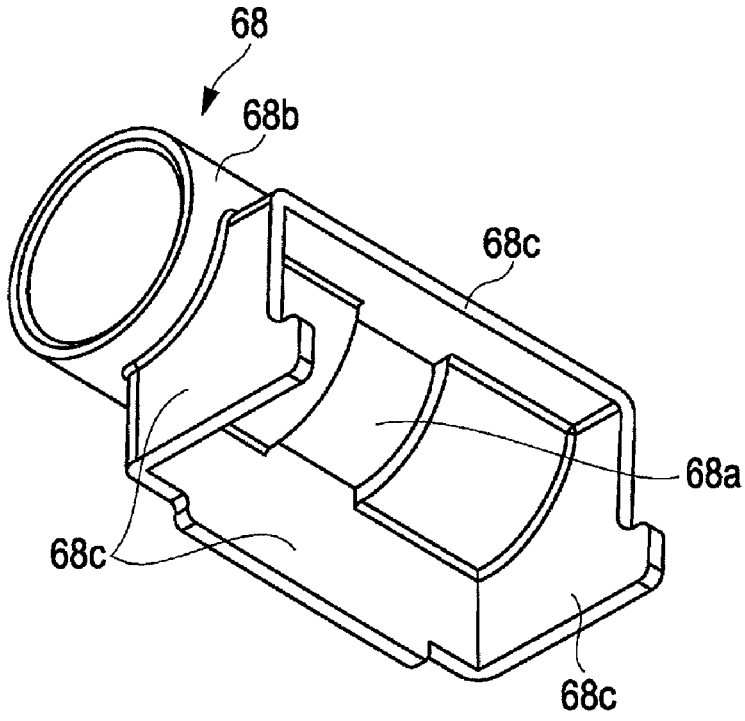
FIG. 12 is a perspective view showing a pipe that is a component of the waste-toner recovery box according to the exemplary embodiment of the invention when viewed from the lower front.
Figure 13:
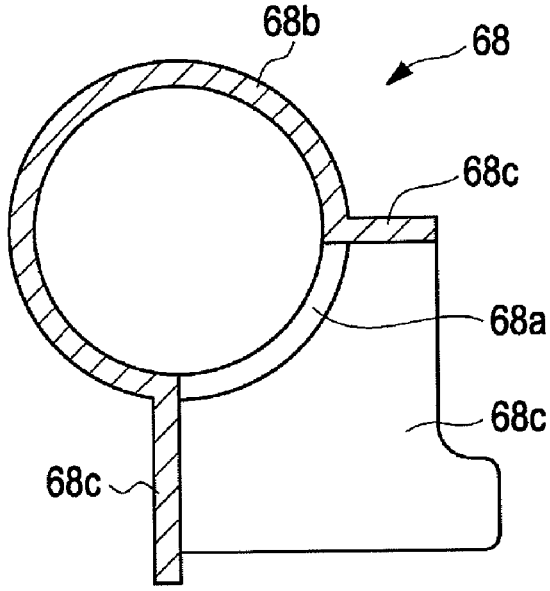
FIG. 13 is a cross-sectional view taken along the diameter of the pipe shown in FIG. 12.

Referring to FIGS. 12 and 13, a pipe 68 (an example of a hollow member) is arranged at the entrance 67*a* of the detection chamber 67. The conveying unit 64 penetrates through the pipe 68. The pipe 68 has a peripheral wall 68*b* serving as a pipe body and an opening 68*a* formed in the peripheral wall 68*b*. The opening 68*a* faces the entrance 67*a* of the detection chamber 67. The ends of conveyance for the waste toner corresponding to the area not occupied by the blade 62*a* or 62*b* are located at the opening 68*a* of the pipe 68. The waste toner does not enter the detection chamber 67 unless the waste toner passes through the pipe 68. The pipe 68 has a partition wall 68*c* that extends downward from the peripheral wall 68*b* and that separates the entrance 67*a* of the detection chamber 67 from the reservoir chamber 61, to prevent the waste toner from entering the detection chamber 67 through a path other than the opening 68*a* of the pipe 68.

With this configuration, when the waste toner locally exceeds the storage limit of the reservoir chamber 61, the excessive waste toner is collapsed and conveyed to the center of the reservoir chamber 61 by the conveying unit 64. Since the waste toner is collapsed to the portion not occupied by the spiral blade 62 of the conveying unit 64, a space is finally left only below the portion not occupied by the spiral blade 62 in the reservoir chamber 61. When the space is eliminated because the waste toner is conveyed by the conveying unit 64, the reservoir chamber 61 is filled with the waste toner. That is, the waste toner reaches the storage limit.

Then, the waste toner exceeding the storage limit is conveyed by the conveying unit 64 and enters into the pipe 68. The waste toner in the pipe 68 enters the detection chamber 67 through the opening 68*a* of the pipe 68. The light transmission sensor 69 detects the waste toner in the sensing chamber 67*c*. Accordingly, the output signal of the light transmission sensor 69 is changed, and it is recognized that the reservoir chamber 61 is full.

If the image forming engines 10Y, 10M, 10C, and 10K are replaced, the waste-toner recovery box 50 located in front of the image forming engines 10Y, 10M, 10C, and 10K has to be detached. At this time, if the detached waste-toner recovery box 50 is left in a state in which the rotating shaft 63 of the conveying unit 64 is not horizontal (i.e., in a state in which the rotating shaft 63 is tilted or vertically stands), the waste toner in the reservoir chamber 61 may be collapsed and part of the waste toner may enter the detection chamber 67 through the entrance 67*a* unless the pipe 68 is provided. Then, if the waste toner enters the detection chamber 67 by a quantity of the waste toner that is detected by the light transmission sensor 69, when the waste-toner recovery box 50 is attached to the printer 1, the output signal of the light transmission sensor 69 may be changed and it may be erroneously recognized that the reservoir chamber 61 is full although the reservoir chamber 61 is not filled with the waste toner.

Also, dust resulted from the waste toner floats in the reservoir chamber 61. The dust is generated mostly when the conveying unit 64 conveys the waste toner, in particular, when the conveying unit 64 collapses the waste toner accumulated like hills when the waste toner locally exceed the storage limit. Hence, if the pipe 68 is not provided, since the generated dust is lighter than the waste toner, part of the dust may not be conveyed by the conveying unit 64 and may float and enter the detection chamber 67 through the entrance 67*a*. If such a state repeatedly appears, the dust is accumulated in the detection chamber 67 by a quantity of the dust that is detected by the light transmission sensor 69. Then the output signal of the light transmission sensor 69 is changed, and it is erroneously detected that the reservoir chamber 61 is full although the reservoir chamber 61 is not filled with the waste toner.

In contrast, in this exemplary embodiment, the conveying unit 64 having the spiral blade 62 penetrates through the pipe 68, the ends of conveyance face the opening 68*a* of the pipe 68, and hence the waste toner in the reservoir chamber 61 does not enter the detection chamber 67 unless the waste toner passes through the pipe 68. The waste toner collapsed when the waste-toner recovery box 50 is detached, and the dust generated when the conveying unit 64 conveys the waste toner are blocked by the pipe 68 and the spiral blade 62 and prevented from entering the detection chamber 67. Accordingly, the erroneous detection that the waste-toner recovery box 50 is full is prevented, and detection accuracy is increased.

As shown in FIG. 9 in detail, the conveying unit 64 is rotatably supported at two positions including the pipe 68 and the supply end (an end of the conveying unit 64 to which the torque is supplied). An end opposite to the supply end is not supported.

With this structure, the noise generated when the conveying unit 64 is rotated is decreased because the supported area is smaller than a case in which the end opposite to the supply end is supported, that is, a case in which the conveying unit 64 is supported at three positions.

Figure 14:
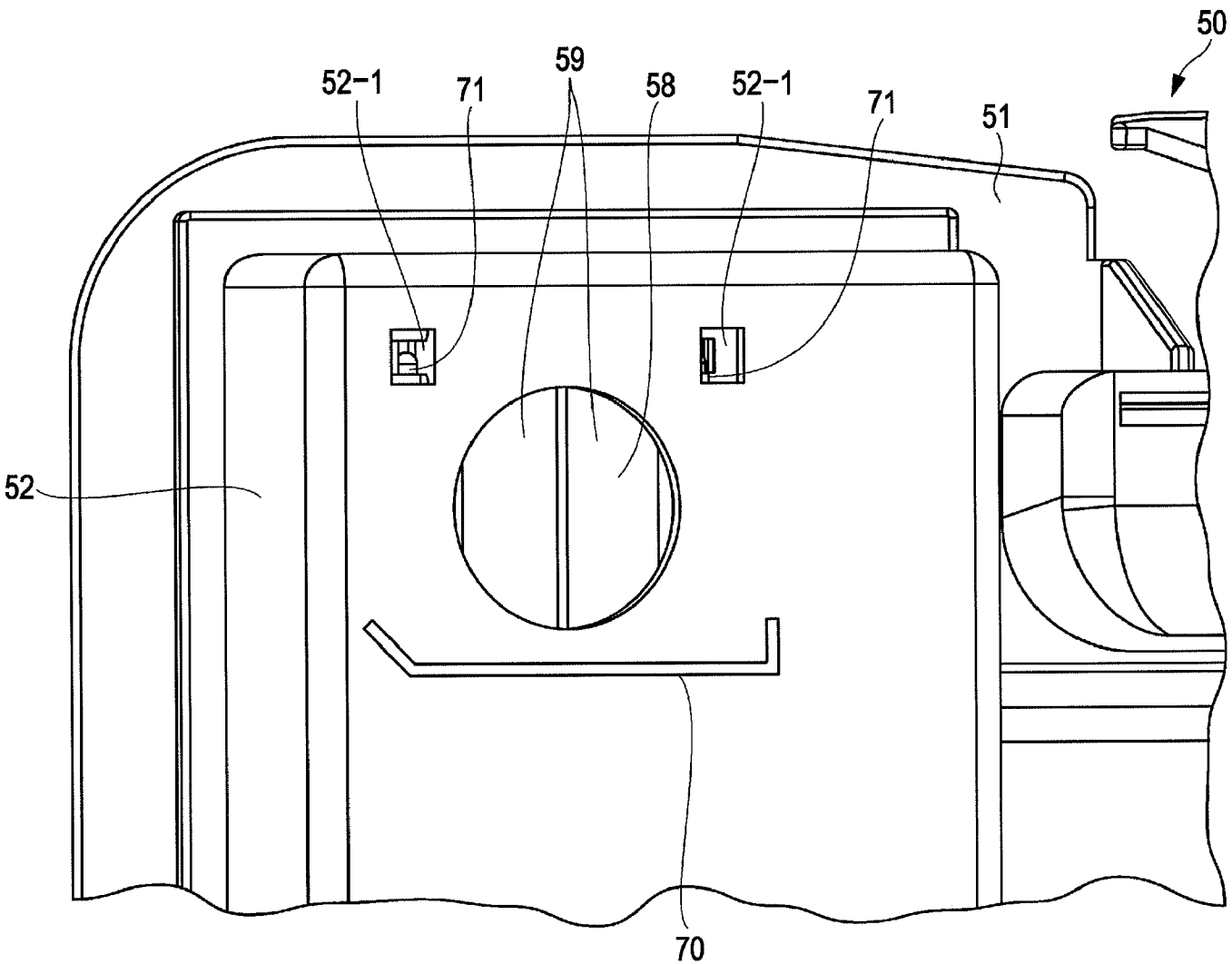
FIG. 14 is a perspective view showing an area around a recovery port of the waste-toner recovery box according to the exemplary embodiment of the invention when viewed from the outside.
Figure 15:
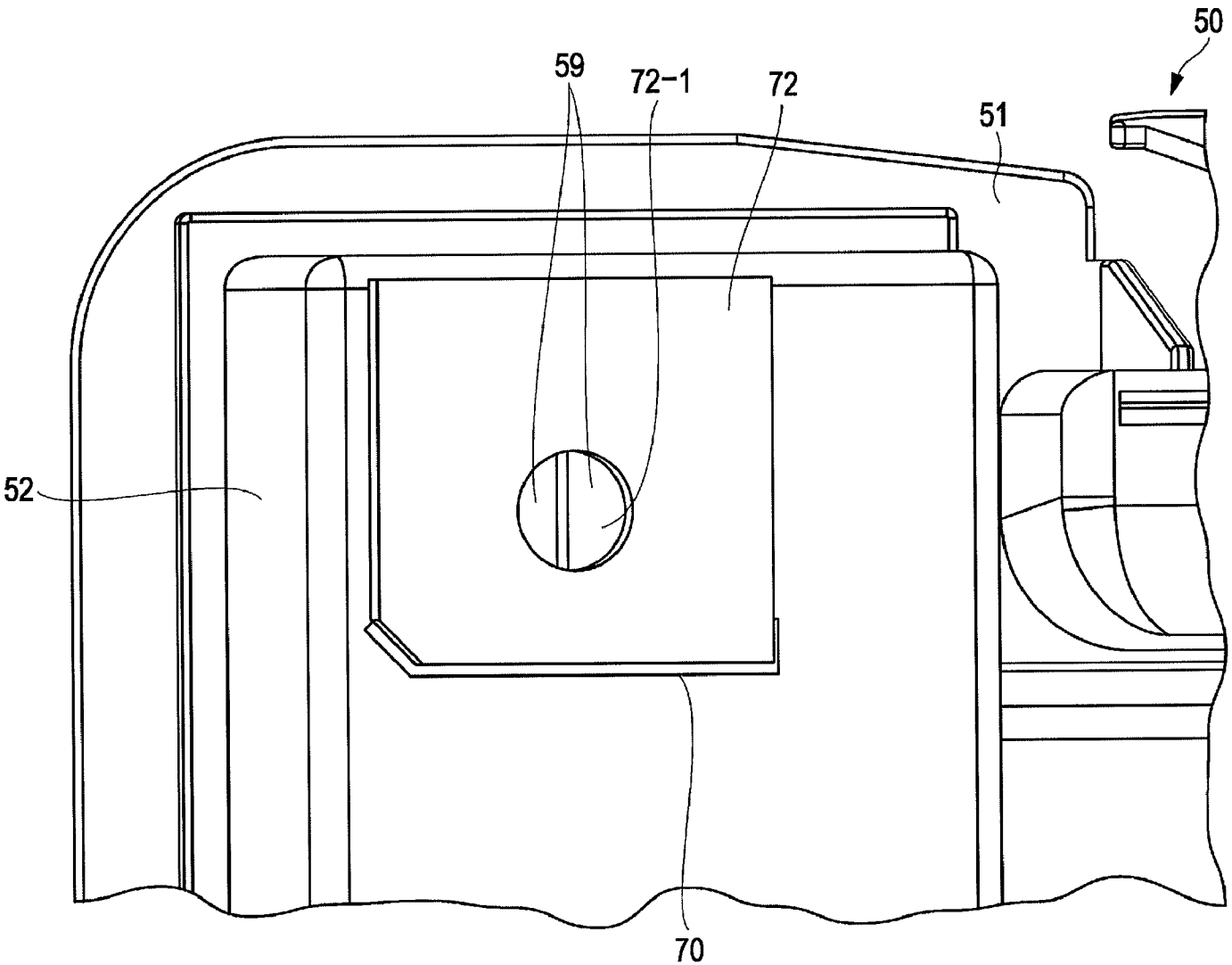
FIG. 15 is a perspective view showing the area around the recovery port of the waste-toner recovery box according to the exemplary embodiment of the invention when viewed from the outside when a plate is attached.

Referring to FIG. 14, a plate holder 70 is formed directly below the recovery port 58 in the outer wall of the rear cover 52. The plate holder 70 extends in the lateral direction and both ends of the plate holder 70 are bent upward. Referring to FIG. 15, the plate holder 70 holds a plate 72. The plate 72 closes two small windows 52-1 through which upper ends of rotating shafts 71 (described later) of the shutters 59 are exposed. The plate 72 has a hole 72-1 with a diameter that is slightly smaller than the outer diameter of the coupling pipe 74 through which the waste toner is conveyed.

Figure 16:
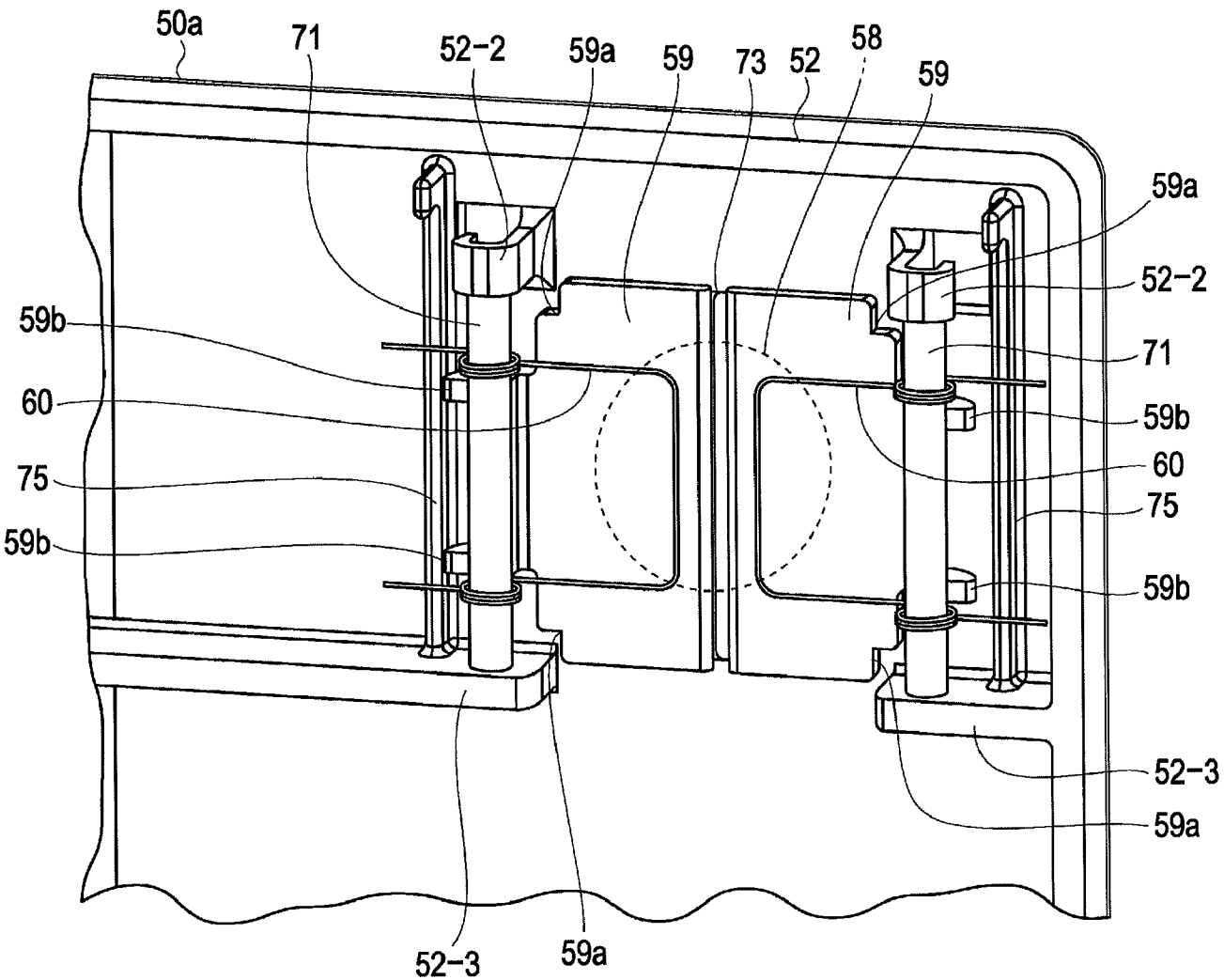
FIG. 16 is a perspective view showing the area around the recovery port of the waste-toner recovery box according to the exemplary embodiment of the invention when viewed from the inside.

As shown in FIG. 16, the shutters 59 have a double-plate structure that opens left and right from the center. The rotating shafts 71 are arranged at two positions with the recovery port 58 arranged therebetween (in this exemplary embodiment, at two positions with the recovery port 58 arranged therebetween in the lateral direction). The shutters 59 are rotated around the rotating shafts 71 toward the reservoir chamber 61 to open and close the recovery port 58. In this exemplary embodiment, each shutter 59 is integrally formed with the corresponding rotating shaft 71. However, the rotating shaft 71 may be provided separately from the shutter 59. Also, the shutters 59 do not have to open left and right, and may open up and down.

Both ends of each of the rotating shafts 71 extending in the vertical direction have small-diameter portions 71*a* and 71*b* (see FIG. 17) having reduced diameters with steps. Referring to FIGS. 16 and 18, the small-diameter portion 71*a* at the upper end is rotatably fitted to a claw 52-2 (an example of a rotating-shaft support member) protruding at the rear cover 52 to the inside. The small-diameter portion 71*b* at the lower end is rotatably fitted to a hole (not shown) in a mount 52-3 (an example of a rotating-shaft support member) formed at the inside of the rear cover 52 and extending in the lateral direction. Since the lower end of the rotating shaft 71 is fitted to the hole of the mount 52-3, the mount 52-3 also functions as a member that supports the shutter 59 through the rotating shaft 71.

Referring to FIG. 16, each shutter 59 has notches 59*a* to avoid the shutter 59 from interfering with the claw 52-2 and the mount 52-3 (the rotating-shaft support members). If the space for the claw 52-2 and the mount 52-3 that support the rotating shaft 71 of the shutter 59 is reduced in the axial direction of the rotating shaft 71, the claw 52-2 and the mount 52-3 may interfere with a rotation region of the shutter 59. Since the shutter 59 has the notches 59*a* as illustrated, the interference between the shutter 59 and the claw 52-2 or the mount 52-3 is avoided.

With this configuration, the distance between the two rotating-shaft support members located at both ends of the rotating shaft 71 (in this exemplary embodiment, the distance between the claw 52-2 at the upper end and the mount 52-3 at the lower end) is decreased. The claw 52-2 and the mount 52-3 (the rotating-shaft support members) do not protrude, and hence the space around the shutter 59 is saved.

Figure 17:
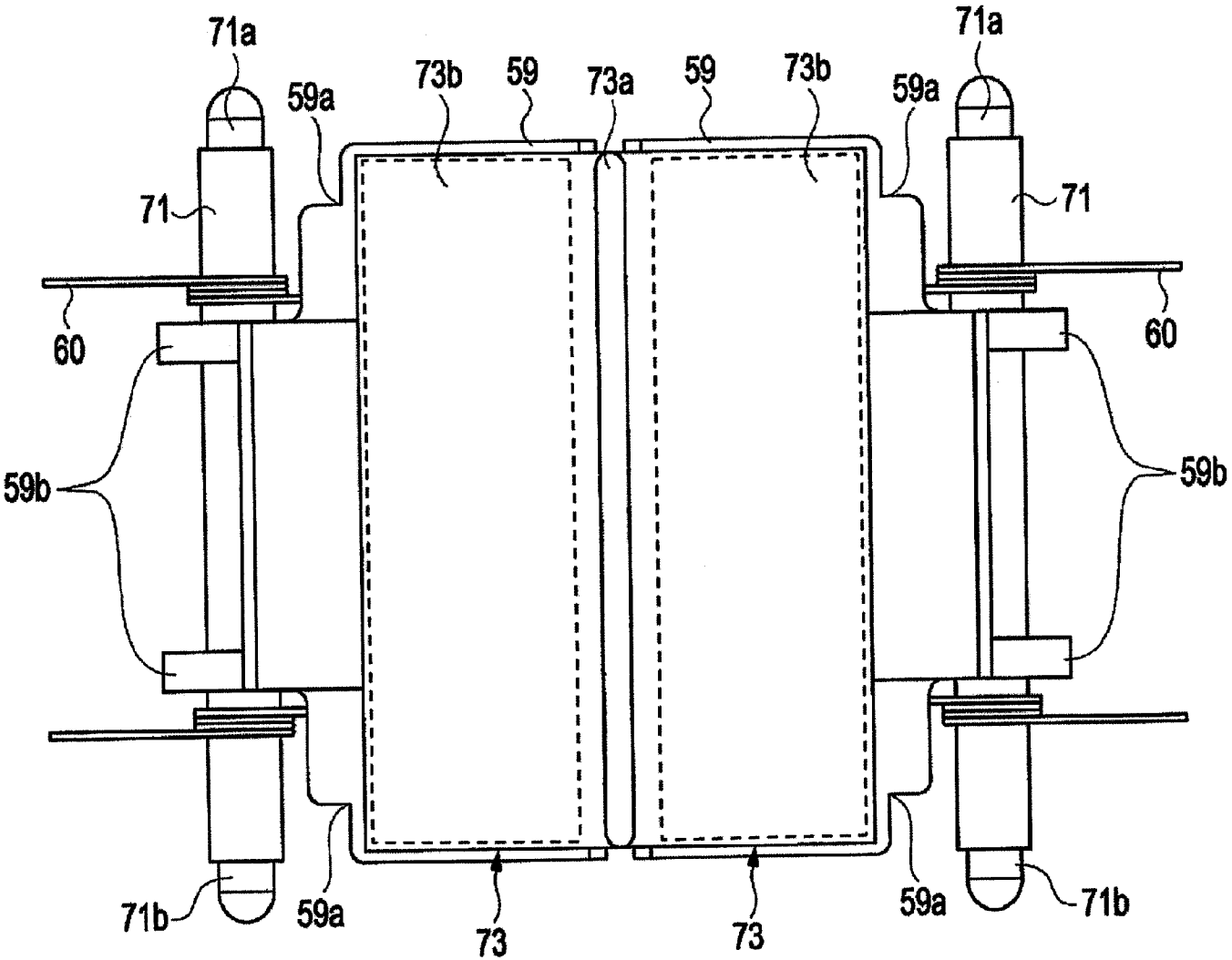
FIG. 17 briefly illustrates shutters attached to the recovery port of the waste-toner recovery box according to the exemplary embodiment of the invention.
Figure 18:
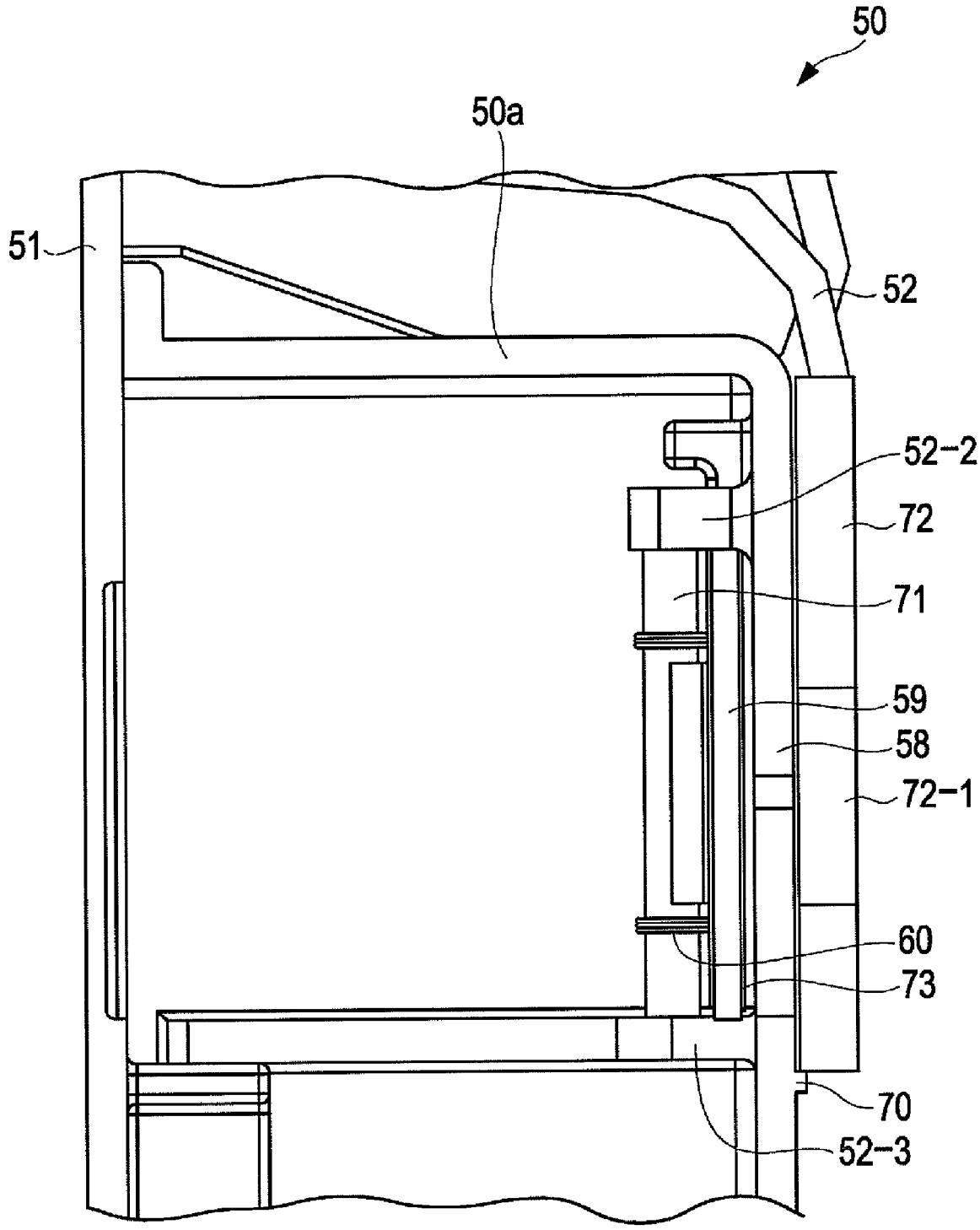
FIG. 18 is a cross-sectional view showing the area around the recovery port of the waste-toner recovery box according to the exemplary embodiment of the invention.

As shown in FIG. 17 in detail, the pair of shutters 59 have films 73 (an example of sealing members) attached thereto. The films 73 protrude from distal ends of the shutters 59. The films 73 overlap one another between the distal ends of the shutters 59 when the shutters 59 are located at positions, at which the recovery port 58 is closed, to seal a gap between the distal ends of the shutters 59 (the gap which is inevitably generated on account of the tolerance as long as the shutters 59 have a double-panel structure).

The film 73 is made of, for example, a polyurethane material. For example, the film 73 is bonded to a surface of the shutter 59 that contacts a peripheral edge of the recovery port 58 (that is, a surface of the shutter 59 that is visually recognizable when the recovery port 58 is viewed from the outside) by using a double-faced adhesive tape. The film 73 may be formed of a material other than polyurethane. The film 73 may be bonded to the shutter 59 by a method other than by using the double-faced adhesive tape.

Referring to FIG. 17, a first part of the film 73 is shown attached to the left shutter 59, and a second part of the film 73 is shown attached to the right shutter 59. Thus, in FIG. 17, a portion 73*a* represents an area in which the two films 73 overlap one another. A portion 73*b* represents an area of the film 73 that is bonded by the double-faced adhesive tape.

Since such shutters 59 have the films 73 provided thereon, the shutters 59 have a rotation radius that is smaller than a rotation radius in a case in which only a single shutter 59 opens and closes the recovery port 58. In addition, the gap that is generated between the distal ends of the shutters 59 when the pair of shutters 59 is used is sealed with the films 73. Therefore, the length in the depth direction of the waste-toner recovery box 50 is restricted, and the waste toner is prevented from leaking from the recovery port 58 when the waste-toner recovery box 50 is detached.

Further, since the film 73 is bonded to the surface of the shutter 59 that contacts the peripheral edge of the recovery port 58, the portion with a large thickness in which the film 73 is overlapped (the portion 73*a* in FIG. 17) is pressed to the peripheral edge of the recovery port 58 by the spring force of the torsion spring 60. Thus, a large sealing force is provided as compared with a case in which the film 73 is bonded to a surface opposite to the aforementioned surface. With this reason, the film 73 is desirably bonded to the surface of the shutter 59 that contacts the peripheral edge of the recovery port 58. However, the film 73 may be bonded to the surface opposite to the aforementioned surface.

Referring to FIGS. 17 and 18, the length of the film 73 along the rotating shaft 71 is smaller than the length of the shutter 59, so that the film 73 does not protrude from the shutter 59 along the rotating shaft 71. Accordingly, the film 73 does not contact the claw 52-2 or the mount 52-3 that is the member arranged at one of ends of the rotating shaft 71 and supporting the rotating shaft 71, and hence the film 73 does not generate abnormal noise. Also, the double-faced adhesive tape of the film 73 is not bonded to the claw 52-2 or the mount 52-3, and hence the double-faced adhesive tape does not disturb the opening and closing operation of the shutter 59.

The upper end of the rotating shaft 71 is fitted to the claw 52-2, and the lower end thereof is fitted to the hole in the mount 52-3 from the upper side. Therefore, when the rotating shaft 71 integrally formed with the shutter 59 is attached, the lower end is fitted to the hole in the mount 52-3, then the upper end is moved toward the recovery port 58 and toward the inside of the waste-toner recovery box 50 while the fitted lower end serves as a supporting point, and the upper end is fitted while the claw 52-2 is elastically deformed. When the rotating shaft 71 is detached, the upper end is moved away from the recovery port 58 and toward the outside of the waste-toner recovery box 50 while the lower end of the rotating shaft 71 serves as the supporting point, and the upper end is detached while the claw 52-2 is elastically deformed. Then, the lower end is removed from the hole in the mount 52-3. If a force is applied to the shutter 59 in a direction toward a wall surface of the container body 50*a*, and the shutter 59 is pushed toward the outside of the waste-toner recovery box 50, the rotating shaft 71 may be detached from the claw 52-2.

Figure 19:
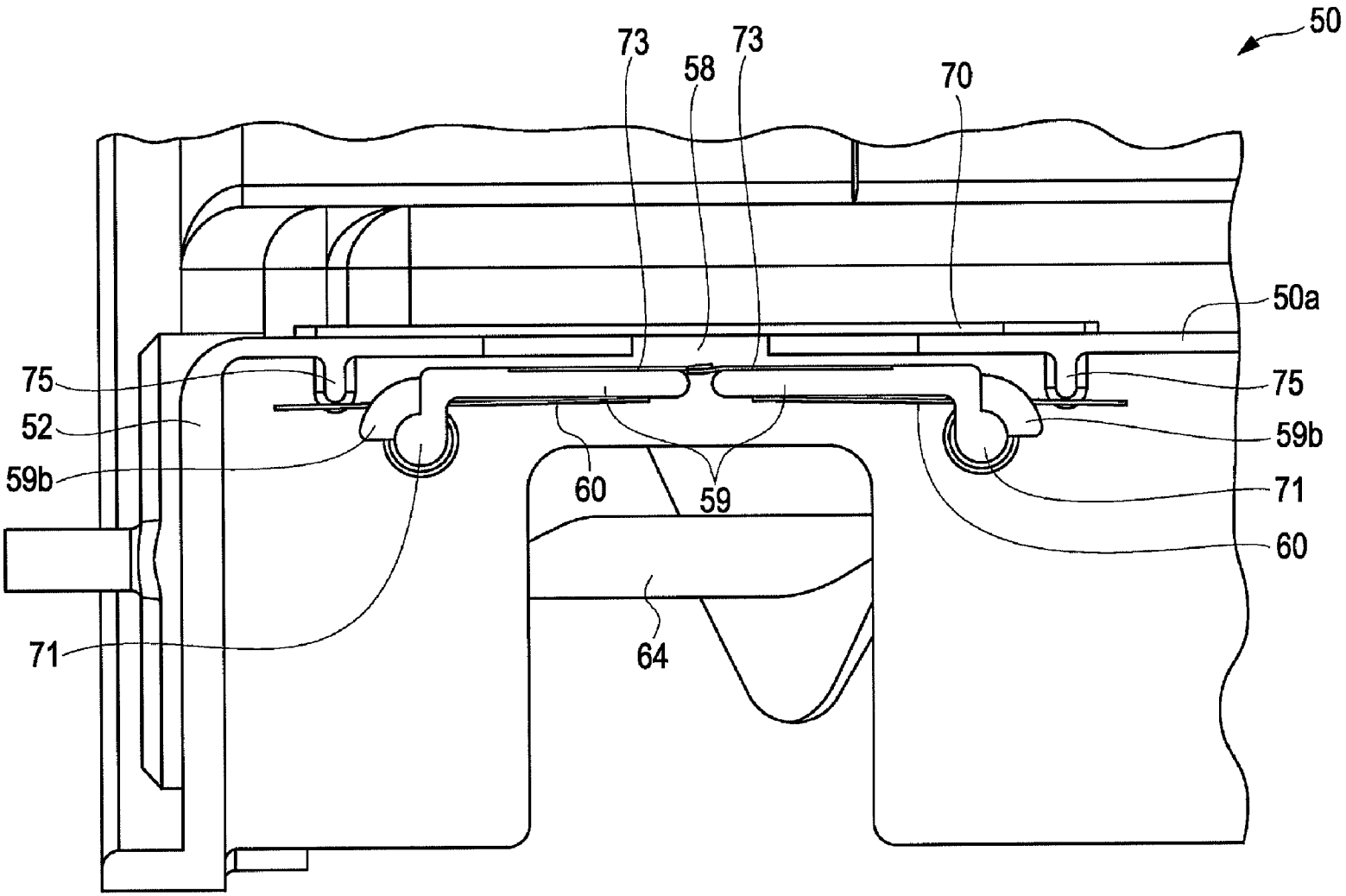
FIG. 19 is a view when the shutters are at positions, at which the recovery port is closed, in the waste-toner recovery box according to the exemplary embodiment of the invention.
Figure 20:
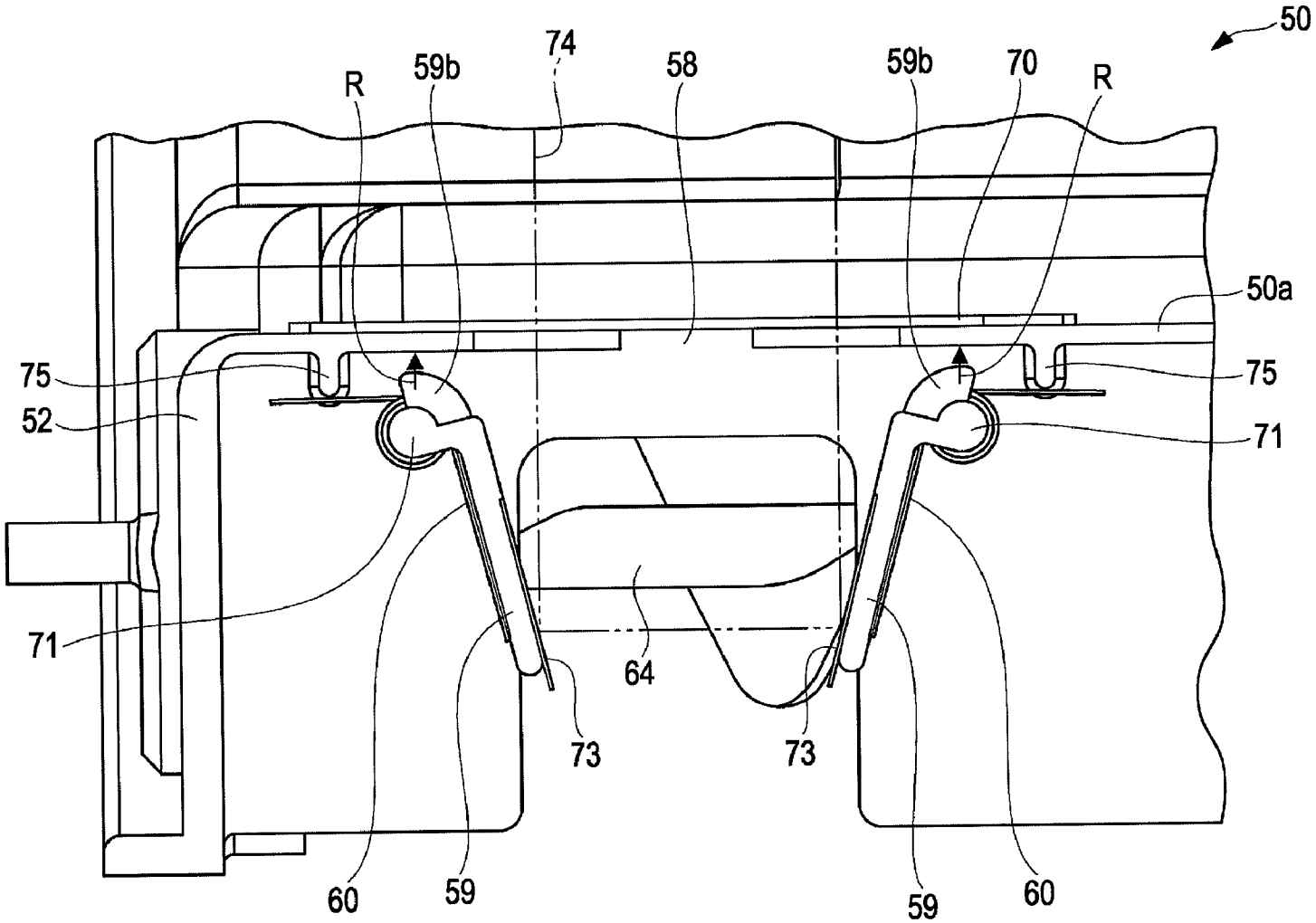
FIG. 20 is a view when the shutters are at positions, at which the recovery port is opened, in the waste-toner recovery box according to the exemplary embodiment of the invention.

When the shutter 59 is rotated between the position, at which the recovery port 58 is closed, as shown in FIG. 19 and a position, at which the recovery port 58 is opened, as shown in FIG. 20 because the coupling pipe 74 is inserted to or removed from the recovery port 58, a force may be applied to the shutter 59 due to the impact at this time such that the shutter 59 is moved to the outside of the waste-toner recovery box 50 (a force in a direction indicated by arrow R in FIG. 20).

Owing to this, in this exemplary embodiment, spacers 59*b* are provided at two positions at ends of the shutter 59 near the rotating shaft 71. Each spacer 59*b* has a fan-like shape along a part of the outer periphery of the rotating shaft 71. The spacer 59*b* faces the wall surface of the container body 50*a* regardless of the position of the spacer 59*b* during the opening and closing operation of the shutter 59. Also, the spacer 59*b*, or the end of the shutter 59 near the rotating shaft 71 is located at a position at a smaller distance from the wall surface of the container body 50*a* than a distance of the rotating shaft 71 by which the rotating shaft 71 is moved toward the wall surface of the container body 50*a* to be detached from the claw 52-2.

Accordingly, if the force is applied to the shutter 59 toward the wall surface of the container body 50*a*, the shutter 59 contacts the wall surface of the container body 50*a* and is inhibited from being moved further. The rotating shaft 71 is prevented from being detached from the claw 52-2.

The spacer 59*b* in this exemplary embodiment has a fan-like shape, however, the shape of the spacer 59*b* may be circular or polygonal along the periphery of the rotating shaft 71.

As described above, in this exemplary embodiment, to apply the urging force to the shutter 59 so that the shutter 59 closes the recovery port 58, the torsion spring 60 is used for using restoration of the twisted part 60*a*.

Figure 21:
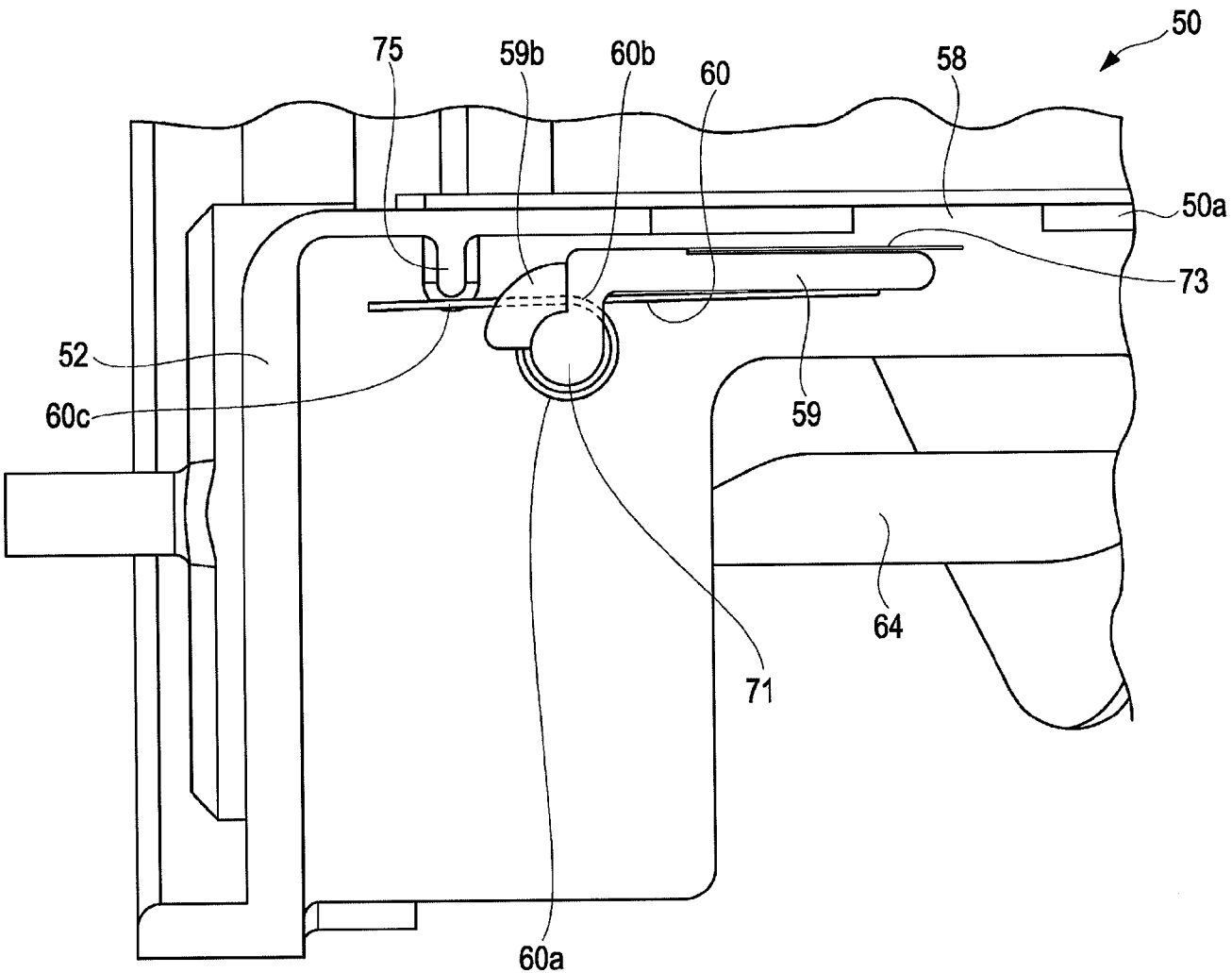
FIG. 21 illustrates a specific part in FIG. 19.
Figure 22:
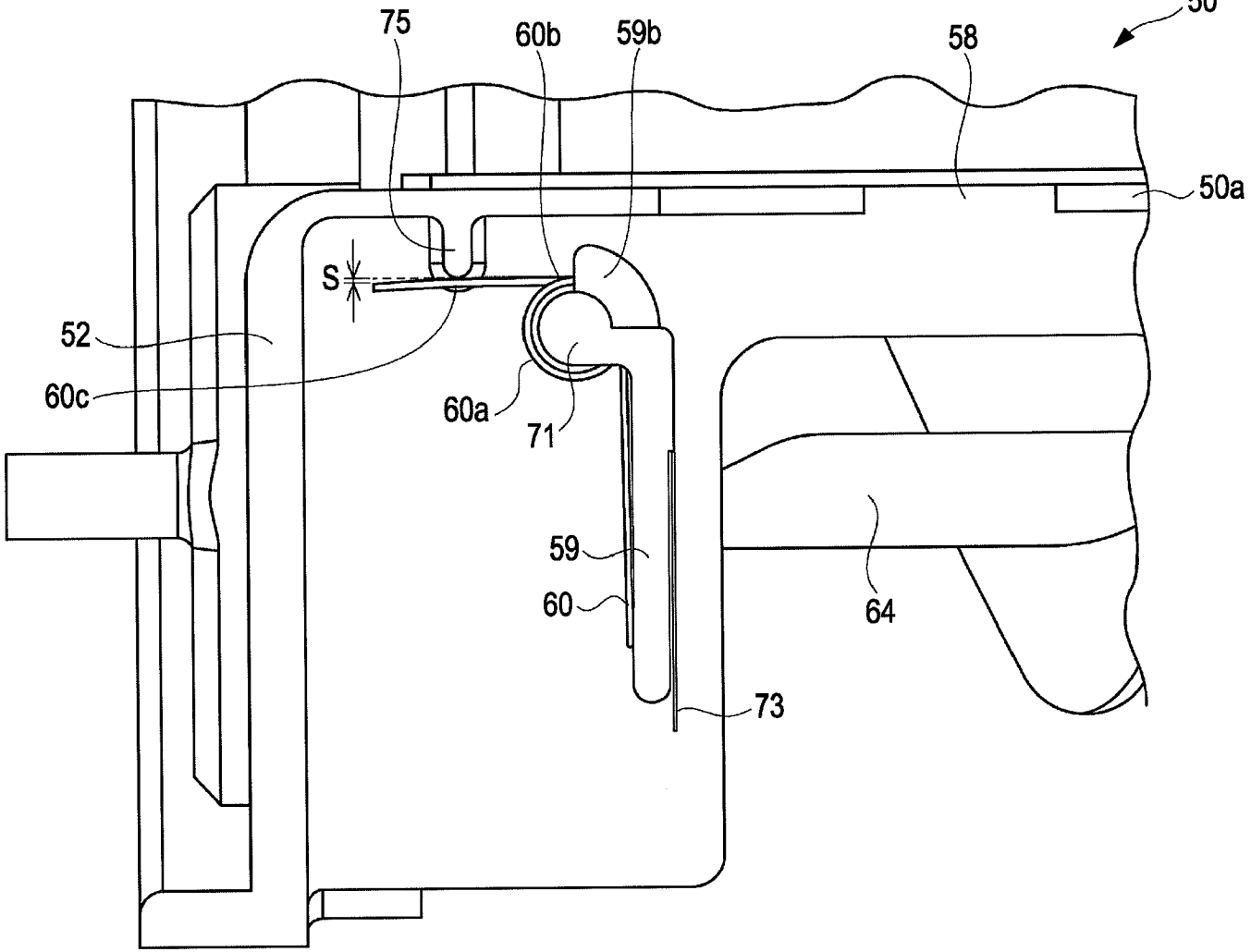
FIG. 22 illustrates a specific part in FIG. 20.

Referring to FIGS. 21 and 22, the container body 50*a*, to which one end of the torsion spring 60 contacts with a pressure, has a protrusion 75. The protrusion 75 maintains a non-contact state between a tip end of the torsion spring 60 and the container body 50*a* when the shutter 59 is rotated. The protrusion 75 has a protruding amount that maintains the non-contact state between the tip end of the torsion spring 60 and the container body 50*a* when the shutter 59 is located at the position, at which the recovery port 58 is closed (the position in FIG. 21).

When the shutter 59 is rotated from the position, at which the recovery port 58 is closed (FIG. 21) to the position, at which the recovery port 58 is opened (FIG. 22), a portion between a terminal 60*b* of the twisted part 60*a* of the torsion spring 60 near the container body 50*a* and a contact position 60*c* between the torsion spring 60 and the protrusion 75 is slightly bent outward. Then, referring to FIG. 22, the tip end of the torsion spring 60 is displaced away from the container body 50*a* (in FIG. 22, a displacement S). As long as the protrusion 75 has the above protruding amount, the tip end of the torsion spring 60 does not contact the container body 50*a* regardless of the rotated position of the shutter 59. Thus, when the shutter 59 is rotated, the tip end of the torsion spring 60 may be prevented from scratching and damaging the wall surface of the container body 50*a*.

When the shutter 59 is at the position, at which the recovery port 58 is closed (the position shown in FIG. 21), the protrusion 75 protrudes by a larger length than a length of a segment that connects a contact position between the tip end of the torsion spring 60 and the container body 50*a*, with the terminal 60*b* of the twisted part 60*a* near the container body 50*a* in a case in which the protrusion is not provided. As long as this is satisfied, the non-contact state between the tip end of the torsion spring 60 and the container body 50*a* is maintained even if the shutter 59 is rotated.

In the above description, the powder recovery container according to the exemplary embodiment of the present invention is applied to an image forming apparatus for recording color images. However, the powder recovery container may be applied to an image forming apparatus for recording monochrome images.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder recovery container, comprising:

a container body having a wall surface;

a reservoir chamber that stores a recovered powder;

a recovery port that faces the reservoir chamber, a powder conveying unit that conveys and recovers the powder through the recovery port being removably inserted into the recovery port;

a pair of door panels having rotating shafts arranged at two positions with the recovery port arranged therebetween, the door panels being rotated toward the reservoir chamber around the rotating shafts to open and close the recovery port;

sealing members attached to the door panels, the sealing members overlapping one another between distal ends of the door panels to seal a gap between the distal ends of the door panels when the door panels are located at positions, at which the recovery port is closed; and urging members that urge the door panels in a direction, in which the recovery port is closed.

2. The powder recovery container according to claim 1, wherein the sealing members are attached to surfaces of the door panels that contact a peripheral edge of the recovery port.

3. The powder recovery container according to claim 1, wherein the sealing members have a smaller length along the rotating shafts than a length of the door panels along the rotating shafts.

4. The powder recovery container according to claim 1, further comprising:

rotating-shaft support members that rotatably support the rotating shafts, wherein the door panels have notches to avoid the door panels from interfering with the rotating-shaft support members.

5. The powder recovery container according to claim 1, wherein an end of each of the door panels near the corresponding rotating shaft is located at a position at a smaller distance from the wall surface of the container body than a distance of the rotating shaft by which the rotating shaft is moved toward the wall surface of the container body to be detached from the corresponding rotating-shaft support member.

6. The powder recovery container according to claim 1, wherein each of the urging member is a torsion spring having a twisted part, the urging member providing an urging force by using restoration of the twisted part, and wherein the container body, to which one end of the torsion spring contacts with a pressure, has a protrusion that maintains a non-contact state between a tip end of the torsion spring and the container body when the corresponding door panel is rotated.

7. The powder recovery container according to claim 6, wherein, when the door panel is at the position, at which the recovery port is closed, the protrusion protrudes by a larger length than a length of a segment that connects a contact position between the tip end of the torsion spring and the container body, with a terminal of the twisted part near the container body in a case in which the protrusion is not provided.

8. An image forming apparatus, comprising the powder recovery container according to claim 1 attached to the image forming apparatus.

* * * * *